US007365594B2

(12) United States Patent
Kojima et al.

(10) Patent No.: US 7,365,594 B2
(45) Date of Patent: Apr. 29, 2008

(54) CURRENT DRIVER, DATA DRIVER, DISPLAY DEVICE AND CURRENT DRIVING METHOD

(75) Inventors: Hiroshi Kojima, Shiga (JP); Tetsuro Omori, Osaka (JP); Makoto Mizuki, Kyoto (JP); Yasuhiro Hirokane, Osaka (JP); Hiroshi Kondo, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 182 days.

(21) Appl. No.: 11/313,958

(22) Filed: Dec. 22, 2005

(65) Prior Publication Data

US 2006/0139065 A1 Jun. 29, 2006

(30) Foreign Application Priority Data

Dec. 24, 2004 (JP) ..... 2004-373076

(51) Int. Cl.
*G05F 1/10* (2006.01)
*G05F 3/02* (2006.01)

(52) U.S. Cl. ..... 327/538; 327/540; 327/541; 327/108

(58) Field of Classification Search ..... None
See application file for complete search history.

(56) References Cited

U.S. PATENT DOCUMENTS 6,118,439 A 9/2000 Ho et al.
6,882,186 B2 4/2005 Nishitoba
6,897,619 B2 * 5/2005 Shimizu ..... 315/169.3
6,900,785 B2 5/2005 Kimura
2004/0178742 A1 9/2004 Date et al.
2005/0024100 A1 * 2/2005 Date et al. ..... 327/105
2005/0024300 A1 * 2/2005 Abe et al. ..... 345/76

FOREIGN PATENT DOCUMENTS

JP 2002-202823 7/2002
JP 2004-198770 7/2004

* cited by examiner

*Primary Examiner*—Tuan T Lam
(74) *Attorney, Agent, or Firm*—McDermott Will & Emery LLP

(57) ABSTRACT

A current driver includes a gate line having a first and second nodes, K driving transistors, a terminal and a voltage generation section. The terminal receives a first current. The voltage generation section generates a bias voltage according to a current value of the first current. The gate line receives, at one of the first and second nodes, the bias voltage generated by the voltage generation section. Gates of the K transistors are connected between the first and second nodes of the gate line. In the voltage generation section, the relationship between the first current and the bias voltage is adjusted in the first mode, according to a current value of an output current flowing in a first driving transistor of the K driving transistors, and in the second mode, according to a current value of an output current flowing in a second driving transistor of the K driving transistors.

18 Claims, 21 Drawing Sheets

CURRENT DRIVER, DATA DRIVER, DISPLAY DEVICE AND CURRENT DRIVING METHOD

CROSS-REFERENCE TO RELATED APPLICATION

The disclosure of Japanese Patent Application No. 2004-373076 filed on Dec. 24, 2004 including specification, drawings and claims are incorporated herein by reference in its entirety.

BACKGROUND OF THE INVENTION

1. Field of the Invention

The present invention relates to a current driver and a current driving method for generating a plurality of currents.

2. Prior Art

In order to drive a large-screen display panel in which display elements such as organic EL (electro luminescence) elements and the like are formed, a current driving apparatus capable of generating a plurality of driving currents is needed. Therefore, there have been cases where two separate semiconductor chips each of which includes a current driving apparatus thereon and which are placed adjacent to each other are used to form a current driving apparatus.

In general, characteristics of transistors formed on the semiconductor chips vary between different semiconductor chips. For example, when a plurality of semiconductor chips are provided, even with application of the same voltage to both of a gate of a transistor formed on one of the plurality of semiconductor chips and a gate of a transistor formed on another one of the plurality of semiconductor chips, respective current values of drain currents output from the transistors might differ from each other. Moreover, between semiconductor chips formed using different fabrication processes, variation in characteristics of respective transistors formed on the semiconductor chips is large.

Furthermore, even between transistors formed on a single semiconductor chip, characteristics of the transistors might vary. For example, there is variation in characteristics of a plurality of transistors continuously formed and, therefore, even with application of the same gate voltage to a gate of each of the plurality of transistors, respective current values of drain currents flowing in the transistors are not the same. However, variation in characteristics of transistors located close to each other is small. That is, respective current values of drain currents flowing in a plurality of transistors continuously formed exhibit a certain slope.

Hereinafter, the case where a current driver A and a current driver B formed on separate semiconductor chips, respectively, are placed adjacent to each other to form a current driving apparatus will be described. Each of the current drivers A and B includes a plurality of transistors (for example, driving transistors T104A-1 through T104A-K in FIG. 20) continuously provided so as to be connected in series.

In this case, in each of the current drivers A and B, there is no large difference between current values of respective output current from two of the plurality of transistors formed on the same chip and located adjacent to each other (for example, the driving transistor T104A-1 and the driving transistor T104A-2 in FIG. 20).

However, if a transistor of the current driver A and a transistor of the current driver B are located adjacent to each other, there is a large difference between respective current values of output currents from the adjacent two transistors (for example, the driving transistor T104A-K and the driving transistor T104B-1 in FIG. 20).

As has been described above, as for output currents from the current driving apparatus, current values of output currents around a boundary line between the current driver A and the current driver B are largely different and, therefore, the respective current values of output currents from the current driving apparatus are not uniform (or do not exhibit a certain slope). Therefore, when a display panel is driven using such output currents, a brightness of the display panel largely varies around the boundary line.

To suppress such a larger difference between current values of output currents, a current driving apparatus has been conventionally proposed.

<Known Current Driving Apparatus>

An overall configuration of a known current driving apparatus (having a two-chip configuration) is shown in FIG. 20. The current driving apparatus includes a current driver 20A and 20B.

Respective configurations of the current drivers 20A and 20B of FIG. 20 will be described. Note that the current drivers 20A and 20B have the same configuration and therefore the configuration of the current driver 20A will be representatively described.

The current driving apparatus 20A includes input terminals 101LA and 101RA, bias voltage generation sections 202LA and 202RA, driving transistors T104A-1 through T104A-K, output terminals 105A-1 through 105A-K, and control section 206LA and 206RA.

The input terminals 101LA and 101RA receive a reference current Iref from the outside. Each of the bias voltage generation sections 202LA and 202RA outputs the bias voltage VbiasA having a voltage value corresponding to a current value of the reference current Iref supplied to the input terminals 101LA and 101RA to a gate line G203. Moreover, the relationship (also referred to as current-voltage conversion capability) between the current value of the reference current Iref input to the bias voltage generation sections 202LA and 202RA and the voltage value of the bias voltage VbiasA output from the bias voltage generation sections 202LA and 202RA is adjusted, according to control signals CTa-1 through CTa-P and control signals CTb-1 through CTb-P. Each of the driving transistors T104A-1 through T104A-K is connected between a ground node and an associated one of the output terminals 105A-1 through 105A-K and a gate of each of the driving transistors T104A-1T through T104A-K is connected to the gate line G203A. Thus, output currents Iout-A(1) through Iout-A(K) flow in the driving transistors T104A-1 through T104A-K, respectively. The output terminals 105A-1 through 105A-K output the output currents Iout-A(1) through Iout-A(K) flowing in the driving transistors T104A-1 through T104A-K to the outside. Each of the control sections 206LA and 206RA is turned to be in a stop state or a drive state, according to operation state instruction signals SA-B from the outside. In a stop state, the control section 206LA (or the control section 206RA) does not output the control signals CTa-1 through CTa-P and the control signals CTb-1 through CTb-P. In a drive state, the control section 206LA (or the control section 206RA) outputs the control signals CTa-1 through CTa-P and control signals CTb-1 through CTb-P, according to a data signal DATA-(K) (or a gate signal DATA-(A1)) to the bias voltage generation section 202LA (or the bias voltage generation section 202RA). The data signal DATA-A(1) corresponds to a current value of the output current Iout-A (1) output from the output terminal 105A-1. The date signal DATA-A(K) corresponds to a current value of the output current Iout-A(K) output from the output terminal 105A-K.

<Internal Configuration of Bias Voltage Generation Section>

The internal configurations of the bias voltage generation sections 202LA and 202RA of FIG. 20 will be described. The bias voltage generation sections 202LA and 202RA have the same internal configuration and therefore the internal configuration of the bias voltage generation section 202LA will be representatively described with reference to FIG. 21.

The bias voltage generation section 202LA includes P voltage generation transistors T110-1 through T110-P, P selection transistors Sa110-1 through Sa110-P, and P selection transistors Sb110-1 through Sb110-P (where P is a natural number).

The control signals CTa-1 through CTa-P and the control signals CTb-1 through CTb-P are voltages which activate the selection transistors Sa110-1 through Sa110-P and the selection transistors Sb110-1 through Sb110-P (i.e., N-channel transistors), respectively, when being the H level, and negate the selection transistors Sa110-1 through Sa110-P and the selection transistors Sb110-1 through Sb110-P (i.e., N-channel transistors), respectively, when being the L level.

Moreover, the control signals CTa-1 through CTa-P are in one-to-one correspondence with the control signals CTb-1 through CTb-P, and when one control signal is the H level, the other control signal corresponding thereto is the L level.

As described above, the number of voltage generation transistors out of the voltage generation transistors T110-1 through T110-P which serve at the input side of a current mirror circuit (i.e., the number of voltage generation transistors in which a gate and a drain are connected to each other and the reference current Iref flows) is increased/reduced, thereby adjusting the current-voltage conversion capability of the bias voltage generation section.

<Operation>

Next, the operation of the known current driving apparatus (having a two-chip configuration) of FIG. 20 will be described.

[Current Driver 20A]

In the current driver 20A, the control section 206LA receives an operation state instruction signal SA-B instructing "stop" and the control section 206RA receives an operation state instruction signal SA-B instructing "drive". Thus, the control section 206LA is turned to be in a stop state. On the other hand, the control section 206RA is turned to be in a drive state where the control signals CTa-1 through CTa-P and the control signals CTb-1 through CTb-P corresponding to the data signal DATA-(K) are output to the bias voltage generation section 202RA.

[Current Driving Apparatus 20B]

In the current driver 20B, the control section 206LB receives an operation state instruction signal SA-B for instructing "drive" and the control section 206RB receives an operation state instruction signal SA-B for instructing "stop". Thus, the control section 206LB is turned to be in a drive state where the control signals CTa-1 through CTa-P and the control signals CTb-1 through CTb-P corresponding to the data signal DATA-(K) are output to the bias voltage generator 202LB. On the other hand, the control section 206RB is turned to be in a stop state.

[Driving Processing]

Next, the input terminal 101RA of the current driver 20A receives the reference current Iref.

Next, the bias voltage generation section 202RA outputs the bias voltage VbiasA corresponding to the current value of the reference current Iref supplied to the input terminal 101RA to the gate line G203A. Accordingly, the output currents Iout-A(1) through Iout-A(K) flow in the driving transistors T104A-1 through T104A-K, respectively.

Next, the output terminals 105A-1 through 105A-K output the output currents Iout-A(1) through Iout-A(K) flowing in the driving transistors T104A-1 through T104A-K, respectively.

On the other hand, the input terminal 101LB of the current driver 20B receives the reference current Iref.

Next, the bias voltage generation section 202LB output a bias voltage having a voltage value corresponding to the current value of the reference current Iref supplied to the input terminal 101LB to the gate line G203B. Accordingly, the output currents Iout-B(1) through Iout-B(K) flow in the driving transistors T104B-1 through T104B-K, respectively.

Next, the output terminals 105B-1 through 105B-K output the output currents Iout-B(1) through Iout-B(K) flowing in the driving transistors T104A-1 through T104A-K, respectively.

[Current Value Measurement Processing]

Next, a current value of the output current Iout-A(K) output from the output terminal 105A-K of the current driver 20A is measured. Meanwhile, a current value of the output current Iout-B(1) output from the output terminal 105B-1 of the current driver 20B is measured.

[Characteristic Adjustment Processing]

Next, the bias voltage generation section 202RA receives a data signal DATA-A(K) corresponding to a measured current value of the output current Iout-A(K). Thus, the current-voltage conversion capability of the bias voltage generation section 202RA is adjusted, so that current values of the output currents Iout-A(1) through Iout-A(K) are changed.

The bias voltage generator 202LB receives a data signal DATA-B(1) corresponding to a current value of a measured output current Iout-B(1). Thus, the current-voltage conversion capability of the bias voltage generator 202LB is adjusted, so that current values of the output currents Iout-B(1) through Iout-B(K) are changed.

As described above, with the bias voltage generation sections 202LA and 202RA (or 202LB and 202RB) provided at first and last ones of the driving transistors T104A-1 through T104A-K (or T104B-1 through T104B-K), respectively, the output currents Iout-A(1) through Iout-A(K) (or Iout-B(1) through Iout-B(K)) can be adjusted. Moreover, the control signals CTa-1 through CTa-P and the control signals CTb-1 through CTb-P corresponding to the current value of the output current Iout-A(K) are supplied to the bias voltage generation section 202RA. Accordingly, a current value of the output current Iout-A(K) can be set to be a proper value. On the other hand, the control signals CTa-1 through CTa-P and the control signals CTb-1 through CTb-P corresponding to a current value of the output current Iout-B(1) are supplied to the bias voltage generator 202LB and the current value of the output current Iout-B(1) can be set to be a proper value. Thus, current values of output currents Iout-A(K) and Iout-B(1) located closest to the boundary line between the current driver 20A and the current driver 20B can be made to match each other.

However, in the known current driver 20A of FIG. 20, the input terminal 101LA, the bias voltage generation section 202LA and the control section 206LA are unnecessary. In the known current driver 20B of FIG. 20, the input terminal 101RB, the bias voltage generator 202RB and the control section 206RB are unnecessary. In each of the known current drivers 20A and 20B, a component(s) which is unnecessary in an operation has to be provided and therefore a circuit size of the current driver is increased.

SUMMARY OF THE INVENTION

According to a first aspect of the present invention, an inventive current driver has a first mode and a second mode. The current driver includes a first gate line, K driving transistors, a first input terminal and a bias voltage generation section (where K is a natural number). The first gate line includes a first node and a second node. Each of the K driving transistors is connected between an output node from which an output current is output and a first reference node indicating a first voltage value. The first input terminal receives a first current having a first current value. The bias voltage generation section generates a bias voltage having a current value corresponding to the current value of the first value supplied to the first input terminal. The first gate line receives the bias voltage generated by the bias voltage generation section at either one of the first and second nodes. Respective gates of the K driving transistors are connected between the first node and the second node on the first gate line. In the bias voltage generation section, the relationship, which is also referred to as current-voltage conversion capability, between a current value of a current received by the bias voltage generation section and the voltage value of the bias voltage generated by the bias voltage generation section is adjusted, according to a current value of an output current flowing in a first driving transistor of the K driving transistors, in the first mode. Moreover, the current-voltage conversion capability is adjusted, according to a current value of an output current flowing in a second driving transistor of the K driving transistors, which is different from the first driving transistor, in the second mode.

In the inventive current driver, the current value of the output current flowing in the first driving transistor can be set to be a desired value in the first mode and the current value of the output current flowing in the second driving transistor can be set to be a desired value in the second mode. Suppose that a current driver (i.e., a current driver A) and a current driver (i.e., a current driver B) which are set to be the first mode and the second mode, respectively, and arranged adjacent to each other are used. Moreover, suppose that the first driving transistor provided in the current driver A and the second driving transistor provided in the current driver B are located close to each other. In such a case, if the current value of the output current flowing in the first driving transistor provided in the current driver A and the current value of the output current flowing in the second driving transistor provided in the current driver B are made to match each other, the current value of the output current from the current driver A and the current value of the output current from the current driver B can be made uniform (or to exhibit a certain slope). That is, there is no large difference among respective current values of output currents around a boundary line between the current driver A and the current driver B. Moreover, unlike the known current driver, a separate component(s) for adjusting a current value of an output current do not have to be provided in each of the first and second driving transistors. Therefore, a circuit size of a current driver can be reduced.

Preferably, a gate of the first driving transistor is located in the vicinity of the first node of the first gate line and a gate of the second driving transistor is located in the vicinity of the second node of the first gate line.

In the inventive current driver, the respective gates of the K driving transistors are connected in series between the first and second nodes. Suppose that a current driver (i.e., a current driver A) and a current driver (i.e., a current driver B) which are set to be the first mode and the second mode, respectively, and arranged adjacent to each other are used. Moreover, suppose that the first node provided on the first gate line in the current driver A and the second node provided on the first gate line in the current driver B are located close to each other. In such a case, if the current value of the output current flowing in the first driving transistor provided in the current driver A and the current value of the output current flowing in the second driving transistor provided in the current driver B are made to match each other, the current value of the output current output from the current driver A and the current value of the output current output from the current driver B can be made uniform (or to exhibit a certain slope).

Preferably, the bias voltage generation section includes P voltage generation transistors (where P is a natural number). The P voltage generation transistors are connected in parallel between the first input terminal and the first reference node. Each of the P voltage generation transistors has a gate and a drain connected to each other. The first gate line receives, at either one of the first and second nodes, a gate voltage generated in each of the P voltage generation transistors. The number P of voltage generation transistors is adjusted, according to the current value of the output current flowing in the first driving transistor, in the first mode. Also, the number P of voltage generation transistors is adjusted, according to the current value of the output current flowing in the second driving transistor, in the second mode.

In the inventive current driver, the number of voltage generation transistors can be increased/reduced, thereby adjusting the current-voltage conversion capability of the bias voltage generation section.

Preferably, the inventive current driver further includes a connection section. In each of X voltage generation transistors out of the P voltage generation transistors, the connection section connects a gate and a drain thereof, where X is a natural number and $X \leqq P$. The number X of voltage generation transistors in which a gate and a drain are connected to each other by the connection section is adjusted, according to the current value of the output current flowing in the first driving transistor, in the first mode. Moreover, the number X of voltage generation transistors in which a gate and a drain are connected to each other by the connection section is adjusted, according to the current value of the output current flowing in the second driving transistor, in the second mode. The first gate line receives a gate voltage generated in each of the gates of the X voltage generation transistors in which a gate and a drain are connected to each other by the connection section at either one of the first and second nodes.

In the inventive current driver, the connection section connects a gate and a drain of a voltage generation transistor. Therefore, if the operation of the connection section is controlled from the outside, the current-voltage conversion capability of the bias voltage generation section can be adjusted from the outside. For example, even after the current driver is mounted on a display panel or the like, the current-voltage conversion capability of the bias voltage generation section can be appropriately adjusted.

Preferably, the inventive current driver further includes a control section. The control section selects X voltage generation transistors from the P voltage generation transistors where X is a natural number and $X \leqq P$. Moreover, the control section selects X current generator transistors from the P voltage generation transistors, according to the current value of the output current flowing in the driving transistor, in the first mode. The control section selects X voltage generation transistors from the P voltage generation transistors, according to the current value of the output current flowing in the second driving transistor, in the second mode. In each of the X voltage generation transistors selected by the control section, the connection section connects a gate and a drain thereof.

In the inventive current drive, the control section adjusts the number of voltage generation transistors in which a gate and a drain are connected by the connection section. Therefore, if the operation of the control section is controlled from the outside, the current-voltage conversion capability of the bias voltage generation section can be adjusted from the outside. For example, even after the current driver is mounted on a display panel or the like, the current-voltage conversion capability of the bias voltage generation section can be appropriately adjusted.

Preferably, the inventive current driver further includes a storage section. The storage section stores information indicating voltage generation transistors to be selected from the P voltage generation transistors by the control section. The control section selects, from the P voltage generation transistors, X voltage generation transistors indicated by the information stored in the storage section.

In the inventive current driver, the control section adjusts the number of generator transistors in which a gate and a drain are connected by the connection section, according to the information stored in the storage section. Therefore, control of the control section from the outside is not necessary. For example, it is unnecessary to control the control section from the outside after the current driver is mounted on a display panel or the like. Moreover, the current-voltage conversion capability of the bias voltage generation section can be appropriately adjusted by appropriately rewriting the information stored in the storage section.

Preferably, the storage section includes a plurality of fuses. The control section has a condition fixing mode and an emulation mode. The control section selects, in the condition fixing mode, X voltage generation transistors from the P voltage generation transistors, according to states of the fuses with respect to whether the fuses are blown or not. Also, the control section emulates, in the emulation mode, the states of the fuses with respect to whether or not the fuses are blown or not, thereby selecting X voltage generation transistors from the P voltage generation transistors.

Preferably, the inventive current driver further includes a current supply section. In the first mode, the current supply section supplies the first current. The bias voltage generation section generates a bias voltage having a current value corresponding to a current value of the first current supplied from the current supply section. In the second mode, the first input terminal receives a current from the outside. The bias voltage generation section generates a bias voltage having a current value corresponding to a current value of a current supplied to the first input terminal.

In the inventive current driver, when current drivers (i.e., a current driver A and a current driver B) which are set to be the first mode and the second mode, respectively, and are arranged adjacent to each other are used, the first input terminal of the current driver B can receive the first current supplied from the current supply section of the current driver A. That is, the current driver A is operated as a master and the current driver B is operated as a slave. In this manner, the inventive current driver can perform an operation as each of a master and a slave. That is, a master and a slave can be formed in a series of fabrication process steps. Accordingly, two current drivers formed through the same process can be used, so that variation in transistor characteristic between semiconductor chips can be reduced.

Preferably, the current supply section includes a second input terminal, a voltage-current conversion section, an output terminal, a setting transistor, a first supply transistor, a second supply transistor, and a second gate line. The setting transistor is connected between a second reference node indicating a second voltage value and the voltage-current conversion section and has a gate and a drain connected to each other. The first supply transistor is connected between the second reference node and the output terminal. The second supply transistor is connected between the second reference node and the bias voltage generation section. To the second gate line, connected are a gate of the setting transistor, a gate of the first supply transistor and a gate of the second supply transistor. In the first mode, the second input terminal receives a reference voltage having a predetermined voltage value. The voltage-current conversion section generates the first current having a current value corresponding to a voltage value of the reference voltage supplied to the second input terminal. The output terminal outputs the first current flowing in the first supply transistor. The bias voltage generation section generates a bias voltage having a voltage value corresponding to the current value of the first current flowing in the second supply transistor. In the second mode, the first input terminal receives a current from the outside. The bias voltage generation section generates a bias voltage having a voltage value corresponding to a current value of a current supplied to the first input terminal.

In the inventive current driver, when current drivers (i.e., a current driver A and a current driver B) which are set to be the first mode and the second mode, respectively, and are arranged adjacent to each other are used, the bias voltage generation section provided in the current driver A receives a current (i.e., a first current) flowing in the second supply transistor and generates a bias voltage having a voltage value corresponding to a current value of the first current. Moreover, the output terminal provided in the current driver A outputs a current (i.e., a first current) flowing in the first supply transistor. On the other hand, the bias voltage generation section provided in the current driver B receives a current supplied to the first input terminal and generates a bias voltage having a voltage value corresponding to a current value of the current. In this case, the first input terminal provided in the current driver B can receive the first current output from the output terminal of the current driver A.

Preferably, the inventive current driver further includes a switching device. The switching device is connected between the second gate line and the second reference node. Moreover, the switching device is turned OFF in the first mode and is turned ON in the second mode.

In the inventive current driver, a voltage of the second gate line has an equal voltage value to that of a gate voltage generated in the gate of the setting transistor in the first mode. In the second mode, on the other hand, the voltage of the second gate line has an equal voltage value to that of the second reference node. Accordingly, the setting transistor and the first and second supply transistors are together operated as a current mirror circuit in the first mode and not operated as a current mirror circuit in the second mode. Therefore, in the second mode, the bias voltage generation section can be kept from receiving a current flowing in the second supply transistor.

Preferably, the inventive current driver further includes a switching device. The switching device is connected between the second supply transistor and the bias voltage generation section. Moreover, the switching device is turned ON in the first mode and is turned OFF in the second mode.

In the inventive current driver, the bias voltage generation section is connected to the second supply transistor in the first mode. In the second mode, on the other hand, the bias voltage generation section is not connected to the second supply transistor. Therefore, in the second mode, the bias generation section can be kept from receiving a current flowing in the second supply transistor.

Preferably, the second gate line includes a third node, a fourth node, a fifth node, and a sixth node. The fifth node is provided between the third node and the fourth node. The sixth node is provided between the fourth node and the fifth node. The gate of the setting transistor is connected to the third node. The gate of the first supply transistor is connected to the fifth node. The gate of the second supply transistor is connected to the fourth node. The inventive current driver further includes a drain current generation section, a first switching device, a second switching device, a third switching device, and a fourth switching device. The drain current generation section generates a second current having a current value corresponding to the voltage value of the bias voltage generated by the bias voltage generation section. The first switching device is connected between the third node and the fifth node on the second gate line. The second switching device is connected between a seventh node and the bias voltage generation section. The seventh node is provided between the second supply transistor and the bias voltage generation section. The third switching device is connected between the sixth node and the seventh node. The fourth switching device is connected between the seventh node and the drain current generation section. In the first mode, the first and second switching devices are turned ON and the third and fourth switching devices are turned OFF. In the second mode, the first and second switching devices are turned OFF and the third and fourth switching devices are turned ON. In the drain current generation section, the relationship between a voltage value of a bias voltage received by the drain current generation section itself and a current value of the second current generated by the drain current generation section itself is adjusted.

In the inventive current driver, when the current driver is set to be the first mode, each of the gates of the first and second supply transistors is connected to the gate of the setting transistor. Accordingly, a current mirror is formed of the setting transistor and the first and second supply transistors, so that the output terminal receives the first current. The bias voltage generation section is connected to a drain of the second supply transistor. Accordingly, the bias voltage generation section receives a first current flowing in the second supply transistor and generates a bias voltage having a voltage value corresponding to a current value of the first current. Moreover, when the current driver is set to be the second mode, the bias voltage generation section receives a current supplied to the first input terminal and generates a bias voltage having a voltage value corresponding to the current value of the current. The drain current generation section generates a second current having a current value corresponding to the voltage value of the bias voltage. A drain of the second supply transistor is connected to the drain current generation section. Accordingly, the second current generated by the drain current generation section flows in the first supply transistor. Moreover, a gate and a drain of the second supply transistor are connected to each other, a current mirror circuit is formed of the first and second supply transistors. Thus, the output terminal outputs the second current flowing in the first supply transistor.

Preferably, the drain current generation section includes Q current generation transistors (where Q is a natural number). The Q current generation transistors are connected in parallel between the fourth switching device and the first reference node. Each of the Q current generation transistors receives a bias voltage generated by the bias voltage generation section at a gate thereof. The number Q of current generation transistors is adjusted, according to a current value of the output current flowing in each of the first and second driving transistors.

In the inventive current driver, the number of current generation transistors can be increased/reduced, thereby adjusting the current-voltage characteristics of the drain current generation section.

According to a second aspect of the present invention, a data driver includes the inventive current driver set to be the first mode, the inventive current driver set to be the second mode, a selection section, and a current output terminal. The selection section selects N output currents from K output currents output from the current driver which is set to be the first mode and K output currents output from the current driver which is set to be the second mode (where N is a natural number and $N \leqq 2K$). The output terminal outputs, as a driving current, a current obtained by summing the N output currents selected by the selection section. Display data indicates a gray scale level.

In the inventive data driver, the current driver set to be the first mode and the current driver set to be the second mode output output currents having a uniform current value. Accordingly, the selection section can generate a driving current having a current value corresponding to the gray scale level represented by the display data with high accuracy.

According to a third aspect of the present invention, a display device includes the inventive data driver and a display panel. The display panel is driven by a driving current output by the data driver.

In the inventive display device, the data driver outputs a driving current having a current value corresponding to the gray scale level represented by the display data. Accordingly, the display panel can be driven with high accuracy.

According to a fourth aspect of the present invention, a current driving method for driving a current driver is provided. The current driver includes a first gate line, K driving transistors, where K is a natural number, a first input terminal, and a bias voltage generation section. The first gate line includes a first node and a second node. The K driving transistors are connected between an output node from which an output current is supplied and a first reference node indicating a first voltage value. The first input terminal receives a first current having a predetermined current value. The bias voltage generation section generates a bias voltage having a voltage value corresponding to a current value of a first current supplied to the first input terminal. The first gate line receives the bias voltage generated by the bias voltage generator at either one of the first and second nodes. Respective gates of the K driving transistors are connected between the first node and the second node. The inventive method has a first mode and a second mode. The method includes the step a) and the step b). In the step a), a current value of an output current flowing in a first driving transistor out of the K driving transistors is measured in the first mode. Also, in the step a), a current value of an output current flowing in a second driving transistor out of the K driving transistors, which is a different driving transistor from the first driving transistor, is measured in the second mode. Moreover, in the step b), according to the current value of the output current measured in the step a), the relationship (which is also referred to as current-voltage conversion capability) between the first current value received by the bias voltage generation section and the voltage value of the bias voltage generated by the bias voltage generation section is adjusted.

According to the inventive method, a current value of an output current flowing in the first driving transistor can be set to be a desired value in the first mode, and a current value of an output current flowing in the second driving transistor can be set to be a desired value in the second mode. Now, suppose that current drivers (i.e., a current driver A and a current driver B) which are set to be the first mode and the second mode, respectively, and arranged adjacent to each other are used. Also, suppose that the first driving transistor provided in the current driver A and the second current transistor provided in the current driver B are located close to each other. In such a case, if a current value of an output current flowing in the first driving transistor provided in the current driver A and a current value of an output current flowing in the second driving transistor provided in the current driver B are made to match each other, the output value of the output current output from the current driver A and the current value of the output current output from the current driver B can be made uniform (or to exhibit a certain slope). That is, current values of output currents are not largely different from each other around a boundary line between the current driver A and the current driver B. Moreover, unlike the known current driver, a separate component(s) for adjusting a current value of an output current do not have to be provided in each of the first and second driving transistors. Therefore, a circuit size of a current driver can be reduced.

Preferably, the bias voltage generation section includes P voltage generation transistors, where P is a natural number. The P voltage generation transistors are connected in parallel between the first input terminal and the first reference node. Each of the P voltage generation transistors has a gate and a drain connected to each other. The first gate line receives a gate voltage generated in each of the P voltage generation transistors at either one of the first and second nodes. In the step b), the number P of voltage generation transistors is preferably adjusted, according to the current value of the output current flowing in the first driving transistor, in the first mode. Also, in the step b), the number P of voltage generation transistors is preferably adjusted, according to the current value of the output current flowing in the second driving transistor, in the second mode.

Preferably, the inventive method further includes the step c). In step c), a gate and drain are connected in each of X voltage generation transistors selected from the P voltage generation transistors, where X is a natural number and $X \leqq P$. Also, in the step c), the number X of the voltage generation transistors in which a gate and a drain are connected to each other is adjusted, according to the current value of the output current flowing in the first driving transistor, in the first mode. Moreover, in the step c), the number X is adjusted, according to the current value of the output current flowing in the second driving transistor, in the second mode. Furthermore, the first gate line receives, at either one of the first and second nodes, the gate voltage generated in each of the respective gates of the X voltage generation transistors in which a gate and a drain are connected to each other in the step c).

Preferably, the inventive method further includes the step d). In the step d), the X voltage generation transistors are selected from the P voltage generation transistors, according to the current value of the output current flowing in the first driving transistor, in the first mode, where X is a natural number and $X \leqq P$. Also, in the step d), the X voltage generation transistors are selected from the P voltage generation transistors, according to the current value of the output current flowing in the second driving transistor, in the second mode. In the step c), in each of the X voltage generation transistors selected in the step d), a gate and drain of each of the X voltage generation transistors are preferably connected to each other.

Preferably, the inventive method further includes the step e). In the step e), information indicating voltage generation transistors to be selected from the P voltage generation transistors in the step d) is stored in a storage medium. In the step d), the X voltage generation transistors are preferably selected from the P voltage generation transistors, according to the information stored in the storage medium in the step e).

DESCRIPTION OF THE PREFERRED EMBODIMENTS

Figure 1:
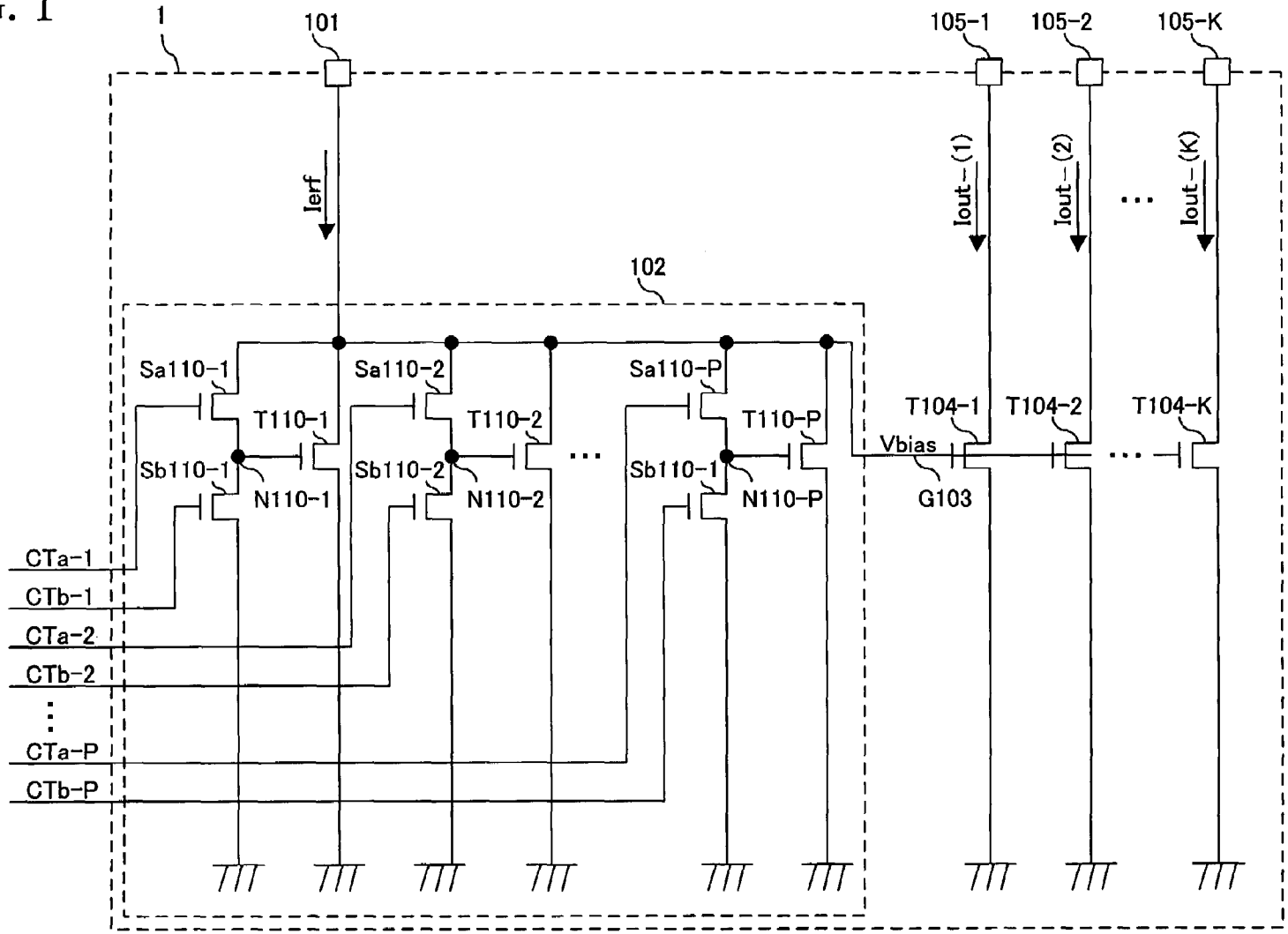
FIG. 1 is a diagram illustrating an overall configuration of a current driver according to a first embodiment of the present invention.

Hereinafter, embodiments of the present invention will be described in detail with reference to the accompanying drawings. The same or like components are denoted by the same reference numerals in the drawings and the descriptions thereof are not repeated.

First Embodiment

<Overall Configuration>

An overall configuration of a current driver 1 according to a first embodiment of the present invention will be described. The current driver 1 generates output currents Iout-(1) through Iout-(K) having current values according to a reference current Iref from the outside. The current driver 1 includes, an input terminal 101, a bias voltage generation section 102, K driving transistors T104-1 through T104-K, and output terminals 105-1 through 105-K (where K is a natural number).

The input terminal 101 receives the reference current Iref from the outside. The bias voltage generation section 102 outputs a bias voltage Vbias having a voltage value corresponding to a current value of the reference current Iref supplied to the input terminal 101. Moreover, in the bias voltage generation section 102, the relationship (current-voltage conversion capability) between a current value of the reference current Iref received by the bias voltage generation section 102 and a current value of the bias voltage Vbias output from the bias voltage generation section 102 is set, according to control signals CTa-1 through CTa-P and control signals CTb-1 through CTb-P (where P is a natural number). The driving transistor T104-1 is connected between an output terminal 105-1 and a ground node and has a gate connected to a gate line G103. Thus, an output current Iout-(1) having a current value corresponding to the bias voltage Vbias flows in the driving transistor T104-1. In the same manner, each of the driving transistors T104-2 through T104-K is connected between a ground node and an associated one of the output terminals 105-2 through 105-K and has a gate connected to the gate line G103. Thus, output currents Iout-(2) through Iout-(K) having current values corresponding to the voltage value of the bias voltage Vbias flow in the driving transistors T104-2 through T104-K, respectively. The output terminal 105-1 outputs the output current Iout-(1) flowing in the driving transistor T104-1 to the outside. In the same manner as the output terminal 105-1, the output terminals 105-2 through 105-K output the output currents Iout-(2) through Iout-(K) flowing in the driving transistors T104-2 through T104-K to the outside.

In this case, it is assumed that the current driver 1 is formed on a single semiconductor chip.

<Bias Voltage Generation Section 102>

The bias voltage generation section 102 of FIG. 1 includes P voltage generation transistors T110-1 through T110-P, P selection transistors Sa110-1 through Sa110-P and P selection transistors Sb110-1 through Sb110-P (where P is a natural number).

The selection transistors Sa110-1 and Sb110-1 are connected in series between the gate line G103 and a ground node. The selection transistor Sa110-1 is connected between the gate line G103 and a node N-110-1 and receives a control signal CTa-1 from the outside at a gate thereof. The selection transistor Sb110-1 is connected between the node N110-1 and the ground node and receives a control signal CTb-1 from the outside at a gate thereof. Each of the selection transistors Sa110-2 through Sa110-P and an associated one of the selection transistors Sb110-2 through Sb110-P are connected in series between the gate line G103 and a ground node in the same manner as the selection transistors Sa110-1 and Sb110-1. Each of the selection transistors Sa110-2 through Sa110-P is connected between the gate line G103 and an associated one of nodes N110-2 through N110-P in the same manner as the selection transistor Sa110-1 and receives an associated one of control signals CTa-2 through CTa-P at a gate thereof. Each of the selection transistors Sb110-2 through Sb110-P receives an associated one of control signals CTb-2 through CTb-P from the outside at a gate thereof in the same manner as the selection transistor Sb110-1.

The voltage generation transistor T110-1 is connected between the gate line G103 and a ground node and the gate thereof is connected to the node N110-1. Each of the voltage generation transistors T110-2 through T110-P is connected between the gate line G103 and a ground node and the gate thereof is connected to an associated one of the node N110-2 through N110-P in the same manner as the voltage generation transistor T110-1.

The control signals CTa-1 through CTa-P and the control signals CTb-1 through CTb-P are voltages which activate the selection transistors Sa110-1 through Sa110-P and the selection transistors Sb110-1 through Sb110-P (i.e., N-channel transistors), respectively, when being the H level and negate the selection transistors Sa110-1 through Sa110-P, and the selection transistors Sb110-1 through Sb110-P (i.e., N-channel transistors), respectively, when being the L level.

The control signals CTa-1 through CTa-P are in one-to-one correspondence with the control signals CTb-1 through CTb-P and when one control signal is the H level, the other control signal corresponding thereto is the L level.

In the bias voltage generation section 102, the number of ones of the voltage generation transistors T110-1 through T110-P in which a gate and a drain thereof are connected to each other and the reference current Iref flows is adjusted by the control signals CTa-1 through CTa-P and the control signals CTb-1 through CTb-P.

<Operation>

The operation of the current driver 1 of FIG. 1 will be described. Operations performed by the current driver 1 include: setting processing in which an operation state of the current driver 1 is set; driving processing in which the current driver 1 is driven; current value measurement processing in which a current value of a certain output current; and characteristic adjustment processing in which current-voltage (I-V) characteristics of the bias voltage generation section 102 are adjusted.

[Setting Process]

First, the current driver 1 is set to be either one of an operation state A and an operation state B.

<<Operation State A>>

First, the case where the current driver 1 is set to be the operation state A will be described.

When the current driver 1 is set to be the operation state A, the bias voltage generation section 102 provided in the current driver 1 is turned to be a state in which the current driver 1 receives of control signals CTa-1 through CTa-P and CTb-1 through CTb-P corresponding to a current value of an output current Iout-(K).

[Driving Processing]

Next, the input terminal 101 receives the reference current Iref.

Next, the bias voltage generation section 102 receives the control signals CTa-1 through CTa-P and the control signals CTb-1 through CTb-P. In this case, it is assumed that the control signals CTa-1 through CTa-5 and the control signals CTb-6 through CTb-P are the H level and the control signals CTa-6 through CTa-P and the control signals CTb-1 through CTb-5 are the L level.

Next, the bias voltage generation section 102 generates a bias voltage Vbias having self-current-voltage conversion capability and a voltage value corresponding to the current value of the reference current Iref. In this case, the selection transistors Sa110-1 through Sa110-5 and the selection transistors Sb110-6 through Sb110-P become active and the selection transistors Sa110-6 through Sa110-P and the selection transistors Sb110-1 through Sb110-5 become inactive. Accordingly, each of the respective gates of the voltage generation transistors T110-1 through T110-5 is connected to the gate line G103. Moreover, each of the respective gates of the voltage generation transistors T110-6 through T110-P is connected to a ground node. Thus, in the voltage generation transistors T110-1 through T110-5, the reference current Iref supplied to the input terminal 101 flows and a gate voltage having a current value corresponding to the reference current Iref is generated at the respective gates of the voltage generation transistors T110-1 through T110-5.

Next, the gate line G103 receives the total voltage of the gate voltages generated at the respective gates of the voltage generation transistors T110-1 through T110-5 as the bias voltage Vbias. In the driving transistors T104-1 through T104-K, output currents Iout-(1) through Iout-(K) having current values corresponding to the bias voltage Vbias supplied to the gate line G103 flow, respectively.

Thus, the output terminals 105-1 through 105-K output the output current Iout-(1) through Iout(K) flowing in the driving transistors T104-1 through T104-K, respectively.

[Current Value Measurement Processing]

Next, a current value of the output current Iout-(K) output from the output terminal 105-K is measured. For example, the current value of the output current Iout-K is measured using a tester or the like.

[Characteristic Adjustment Processing]

Next, the bias voltage generation section 102 receive of the control signals CTa-1 through CTa-P and CTb-1 through CTb-P corresponding to the current value of the output current Iout-(K) output from the output terminal 105-K. In this case, when the current value of the output current Iout-(K) is smaller than a desired current value, the control signals CTa-1 through CTa-P and the control signals CTb-1 through CTb-P for reducing the number of ones of the voltage generation transistors T110-1 through T110-P in which a gate and a drain are connected to each other and the reference Iref flows are supplied to the bias voltage generation section 102. For example, in this case, the control signals CTa-1 through CTa-3 and the control signals CTb-4 through CTb-P exhibit the H level and the control signals CTa-4 through CTa-P and the control signals CTb-1 through CTb-3 exhibit the L level. On the other hand, when the current value of the output current Iout-(K) is larger than the reference value, the control signals CTa-1 through CTa-P and the control signals CTb-1 through CTb-P for increasing the number of ones of the voltage generation transistors T110-1 through T110-P in which a gate and a drain are connected to each other and the reference current Iref flows are supplied to the bias voltage generation section 102.

As described above, the number of ones of the voltage generation transistors T110-1 through T110-P in which a gate voltage is generated in a gate is adjusted, thereby increasing/reducing the voltage value of the bias voltage Vbias output from the bias voltage generation section 102. Specifically, when the value of the output current Iout-(K) is smaller than a reference value, the voltage value of the bias voltage Vbias is increased. When the current value of the output current Iout-(K) is larger than the reference value, the voltage value of the bias voltage is reduced.

Thus, when the current driver 1 is set to be an operation state A, the current value of the output current Iout-(K) output from the output terminal 105-K can be set to be a reference value.

<<Operation State B>>

Next, the case where the current driver 1 is set to be an operation state B will be described.

When the current driver 1 is set to be an operation state B, the bias voltage generation section 102 becomes a state where the bias voltage generation section 102 receives of the control signals CTa-1 through CTa-P and the control signals CTb-1 through CTb-P corresponding to the current value of the output current Iout-(1).

[Driving Processing]

Next, the same processing as the processing in the operation state A is performed and the output terminals 105-1 through 105-K output the output current Iout-(1) through Iout-(K) flowing in the driving transistors T104-1 through T104-K, respectively.

[Current Value Measurement Processing]

Next, the current value of the output current Iout-(1) output from the output terminal 105-1 is measured.

[Characteristic Adjustment Processing]

Next, the bias voltage generation section 102 receives one(s) of the control signals CTa-1 through CTa-P and the control signals CTb-1 through CTb-P corresponding to the current value of the output current Iout-(1) output from the output terminal 105-1. When the current value of the output current Iout-(1) is smaller than a desired current value (reference value), the control signals CTa-1 through CTa-P and the control signals CTb-1 through CTb-P for reducing the number of ones of the voltage generation transistors T110-1 through T110-P in which a gate and a drain are connected to each other and the reference current Iref flows are supplied to the bias voltage generation section 102. On the other hand, when the current value of the output current Iout-(1) is larger than the reference value, the control signals CTa-1 through CTa-P and the control signals CTb-1 through CTb-P for increasing the number of ones of the voltage generation transistors T110-1 through T110-P in which a gate and a drain are connected to each other and the reference current Iref flows are supplied to the bias voltage generation section 102.

Thus, when the current driver 1 is set to be the operation state B, the current value of the output current Iout-(1) output from the output terminal 105-1 is set to be the reference value.

<Current Driving Apparatus>

Figure 2:
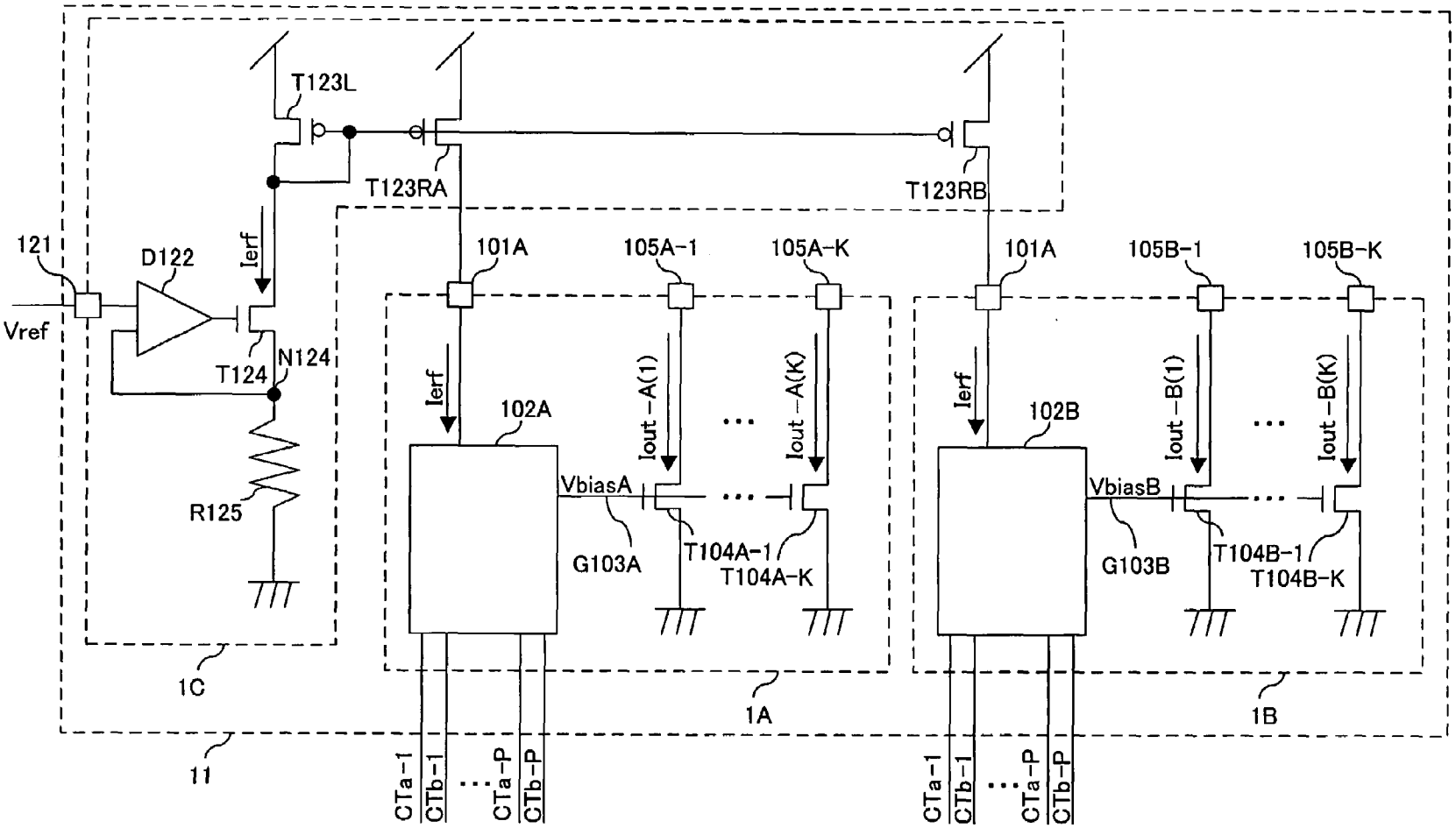
FIG. 2 is a diagram illustrating an overall configuration of a driving apparatus according to the first embodiment of the present invention.

An overall configuration of a current driving apparatus 11 according to the first embodiment of the present invention is shown in FIG. 2. The driving apparatus 2 includes a reference current supply section 1C and two current drivers 1A and 1B. The reference current supply section 1C supplies the reference current Iref to each of the current drivers 1A and 1B. Each of the current drivers 1A and 1B has the same configuration as the configuration of the current driving apparatus 1 of FIG. 1. The current driver 1A is set to be the operation state A. The current driver 1B is set to be the operation state B.

<Internal Configuration of Reference Current Supply Section 1C>

The reference current supply section 1C includes an input terminal 121, a differential amplifier circuit D122, a setting transistor T123L, supply transistors T123RA and T123RB, an adjusting transistor T124, and a load resistance R125.

The internal terminal 121 receives the reference voltage Vref from the outside. The supply transistor T123L, the adjusting transistor T124 and the load resister R125 are connected in series between a power supply node and a ground node. The supply transistor T123L is connected between the power supply node and the adjusting transistor T124 and a gate and a drain of the supply transistor T123L are connected to each other. The adjusting transistor T124 is connected between the supply transistor T123L and the load resistance R125 and a gate of the adjusting transistor T124 is connected to an output terminal of the differential amplifier circuit D122. The load resistance R125 has a predetermined resistance value and is connected between the adjusting transistor T124 and the ground node. The differential amplifier circuit D122 has one input terminal connected to the input terminal 121, the other input terminal connected to a node N124 provided between the adjusting transistor T124 and the load resistance R125 and an output terminal to which a gate of the adjusting transistor T124 is connected. The differential amplifier circuit D122, the adjusting transistor T124 and the load resistance R125 together form a voltage-current conversion circuit and generate the reference current Iref having a current value corresponding to the voltage value of the reference voltage Vref input into the input terminal 121. The reference current Iref generated by the voltage-current conversion circuit flows in the setting transistor T123L. Accordingly, a gate voltage having a voltage value according to the current value of the reference current Iref is generated in the gate of the setting transistor T123L.

The supply transistor T123RA is connected between the power supply node and the input terminal 101A of the current driver 1A and receives the gate voltage generated in the gate of the setting transistor T123L at a gate thereof. The supply transistor T123RB is connected between the power supply node and an input terminal 101B of the current driver 1B and receives a gate voltage generated in the gate of the setting transistor T123L at a gate thereof.

In this case, it is assumed that the supply transistors T123RA and T123RB have the same or substantially the same transistor characteristics (i.e., the same relationship between a voltage value of a voltage received at a gate of a transistor and a current value of a drain current flowing in the transistor) as those of the setting transistor T123L. Therefore, the reference current Iref (a drain current having an equal or substantially equal current value to the reference current Iref) flows in each of the supply transistors T123RA and T123RB.

<The Operation of Lager-size Current Driving Apparatus>

Next, the operation of the current driving apparatus 11 of FIG. 2 will be described.

[Reference Current Supply Section 1C]

First, the input terminal 121 receives the reference voltage Vref from the outside. The voltage-current conversion circuit formed of the differential amplifier circuit D122, the adjusting transistor T124 and the load resistance R125 generates the reference current Iref having a current value corresponding to the voltage value of the reference voltage Vref. The reference current Iref generated by the voltage-current conversion circuit flows in the setting transistor T123L.

Next, a current mirror circuit formed of the setting transistor T123L and the supply transistors T123RA and T123RB supplies the reference current Iref to each of the input terminal 101A of the current driver 1A and the input terminal 101B of the current driver 1B.

[Current Driver 1A]

Next, the current driver 1A performs the same processing (i.e., driving processing (operation state A)) as that the current driver 1 of FIG. 1. Therefore, a bias voltage generation section 102A generates the bias voltage VbiasA having a voltage value corresponding to the current value of the reference current Iref supplied to the input terminal 101A. The output terminals 105A-1 through 105A-K output output currents Iout-A(1) through Iout-A(K) having current values corresponding to the voltage value of the bias voltage VbiasA.

Next, in the current driver 1A, the same operation (i.e., current value measurement processing) as that of the current driver 1 of FIG. 1 is performed (operation state A). Thus, the current value of the output current Iout-A(K) is measured.

[Current Driver 1B]

The current driver 1B performs the same processing (i.e., driving processing (operation state B)) as that of the current driver 1 of FIG. 1. Thus, the bias voltage generation section 102B generates a bias voltage VbiasB having a voltage value corresponding to the current value of the reference current Iref supplied to the input terminal 101B. The output terminals 105B-1 through 105B-K output the output currents Iout-B(1) through Iout-B(K) corresponding to the voltage value of the bias voltage VbiasB, respectively.

Next, in the current driver 1B, the same operation i.e., (current value measurement processing (operation state B)) as that of the current driving apparatus 1 of FIG. 1 is performed. Thus, a current value of the output current Iout-B(1) is measured.

Figure 3A:
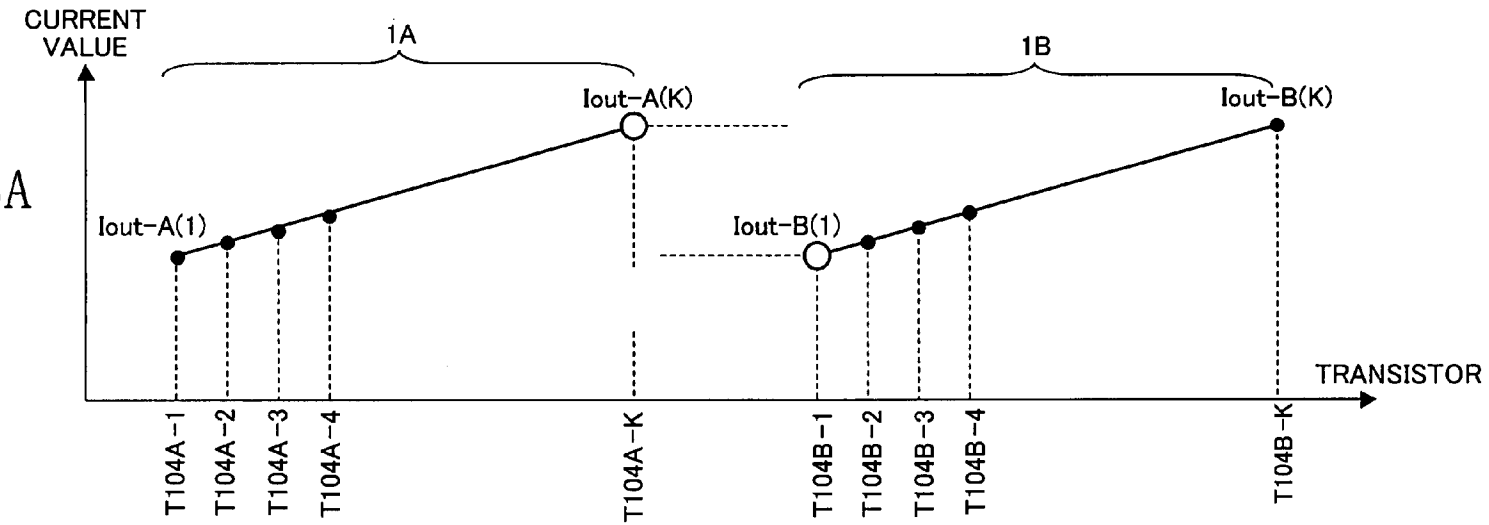
FIGS. 3A-3B are a graph showing the relationship between driving transistors and current values of output currents thereof.

In this case, it is assumed that the relationship between each of the driving transistors T104A-1 through T104A-K and the driving transistors T104B-1 through T104B-K and an associated one of respective current values of the output currents Iout-A(1) through Iout-A(K) and the output currents Iout-B(1) through Iout-B(K) flowing in the driving transistors is as shown in FIG. 3A. In this case, there is a large difference between the current value of the output current Iout-A(K) flowing in the driving transistor T104-K of the current driver 1A and the current value of the output current Iout-B(1) flowing in the driving transistor T104B-1 of the current driver 1B.

[Current Driver 1A]

Figure 3B:
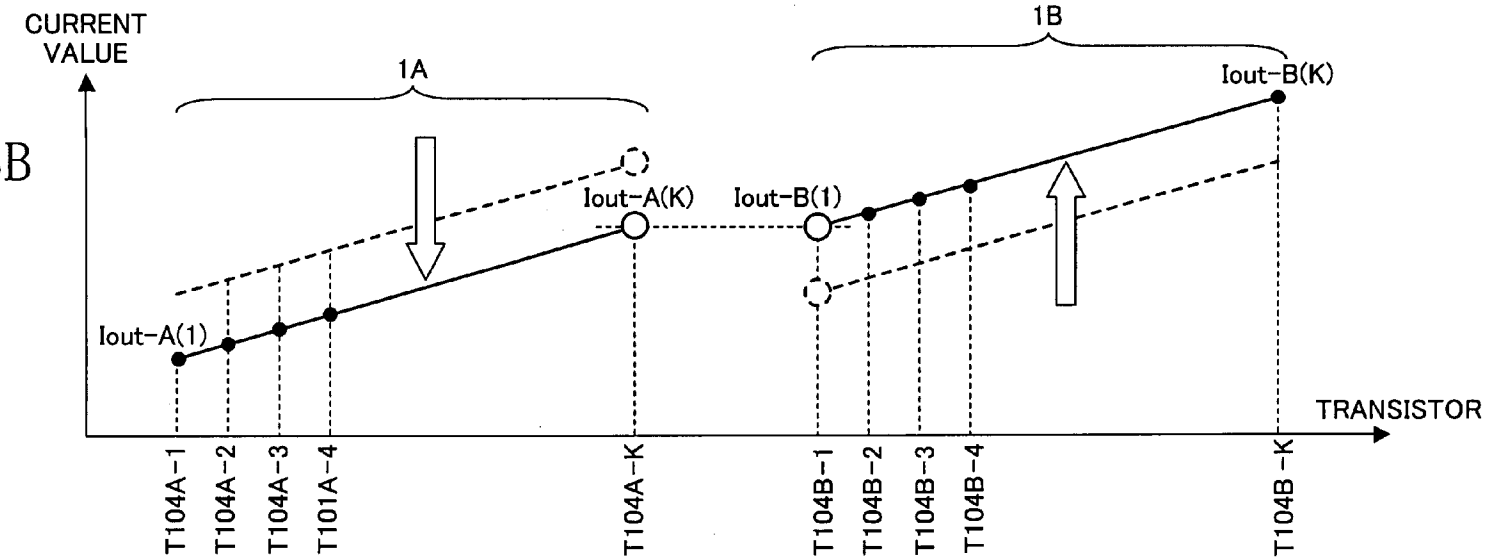

Next, the current driver 1A performs the same operation (i.e., characteristic adjustment processing (operation state A)) as that of the current driving apparatus 1 of FIG. 1. Specifically, the bias voltage generation section 102A of the current driver 1A newly receives the control signals CTa-1 through CTa-P and the control signals CTb-1 through CTb-P corresponding to the current value of the measured output current Iout-A(K). In this case (i.e., the case of FIG. 3A), the control signals CTa-1 through CTa-P and the control signals CTb-1 through CTb-P for increasing the number of ones of the voltage generation transistors T110-1 through T110-P in which a gate and a drain are connected to each other and the reference current Iref flows are newly supplied to the bias voltage generation section 102A of the current driver 1A. Accordingly, the voltage value of the bias voltage VbiasA output from the bias voltage generation section 102A to a gate line G103A is reduced. Thus, the respective current values of the output currents Iout-A(1) through Iout-A(K) flowing in the driving transistors T104A-1 through T104A-K are reduced as shown in FIG. 3B.

[Current Driver 1B]

The current driver 1B performs the same operation (i.e., characteristic adjustment processing (operation state B)) as that of the current driver 1 of FIG. 1. Specifically, the bias voltage generation section 102B of the current driver 1B newly receives the control signals CTa-1 through CTa-P and the control signals CTb-1 through CTb-P corresponding to the current value of the measured output current Iout-B(1). In this case (i.e., the case of FIG. 3A), the control signals CTa-1 through CTa-P and the control signals CTb-1 through CTb-P for reducing the number of ones of the transistors T110-1 through T110-P in which a gate and a drain are connected to each other and the reference current Iref flows are newly supplied to the bias voltage generation section 102B of the current driver 1B. Accordingly, the voltage value of the bias voltage VbiasB output from the bias voltage generation section 102B to the gate line G103 is increased. Thus, the respective current values of the output currents Iout-B(1) through Iout-B(K) flowing in the driving transistors T104B-1 through T104B-K are increased as shown in FIG. 3B.

As described above, according to the current value of the output current Iout-A(K) flowing in the driving transistor T104A-K (or the current value of the output current Iout-B (1) flowing in the driving transistor T104B-1), the control signals CTa-1 through CTa-P and the control signals CTb-1 through CTb-P supplied to each of the bias voltage generators 102A and 102B are adjusted. Thus, as shown in FIG. 3B, the current value of the output current Iout-A(K) of the current driver 1A and the current value of the output current Iout-B(1) of the current driver 1B can be made to match each other.

<Effects>

As has been described above, the current driver 1 is set to be in either one of the two operation states (i.e., the operation state A and the operation state B) and the control signals CTa-1 through CTa-P and the control signals CTb-1 through CTb-P corresponding to the operation state are supplied. Thus, each of the respective current values of the output currents Iout-(1) and Iout-(K) can be set to be a desired value.

Moreover, if the current value of the output current Iout-(1) and the current value of the output current Iout-(K) are made to match each other, respective current values of output currents (i.e., the output currents Iout-A(1) through Iout-A(K) and the output currents Iout-B(1) through Iout-B (K)) from the driving apparatus 11 can be made uniform (or to have a certain tilt). That is, a large difference between respective values of output currents around a boundary line between the current driver 1A and the current driver 1B can be eliminated.

Moreover, compared to known techniques, part of a circuit area occupied by components for adjusting the current values of the output currents Iout-(1) and Iout-(K) can be reduced.

Moreover, connection states of the voltage generation transistors T110-1 through T110-P can be controlled from the outside by the control signals CTa-1 through CTa-P and the control signals CTb-1 through CTb-P. Accordingly, for example, even after a current driver has been mounted on a display panel, the current-voltage conversion capability of the bias voltage generation section 102 can be appropriately adjusted and the current values of the output currents Iout-(1) through Iout-(K) can be adjusted.

In matching the current value of the output current Iout-A(K) of the current driver 1A and the current value of the output current Iout-B(1) of the current driver 1B each other, the control signals CTa-1 through CTa-P supplied to the bias voltage generation section 102A and the control signals CTb-1 and CTb-P supplied to the bias voltage generation section 102B may be adjusted, according to a difference in current value between the output current Iout-A(K) of the current driver 1A and the output current Iout-(1) of the current driver 1B.

Moreover, an operation state of each current driver may be set, according to the arrangement of current drivers. Specifically, when a current driver (i.e., a current driver A) and another current driver (i.e., a current driver B) are provided as to be arranged in this order in the direction from a driving transistor T104-1 to a driving transistor T104-K, the current driver A is set to be the operation state A and the current driver B is set to be the operation state B.

Moreover, although in this embodiment, the output currents Iout-(1) and Iout-(K) are measurement targets, measuring targets are not limited thereto. It is preferable that measuring targets are driving transistors located around both ends of a current driver.

Moreover, the voltage generation transistors T110-1 through T110-P do not have to exhibit the same transistor characteristics.

Modified Example of First Embodiment

Figure 4:
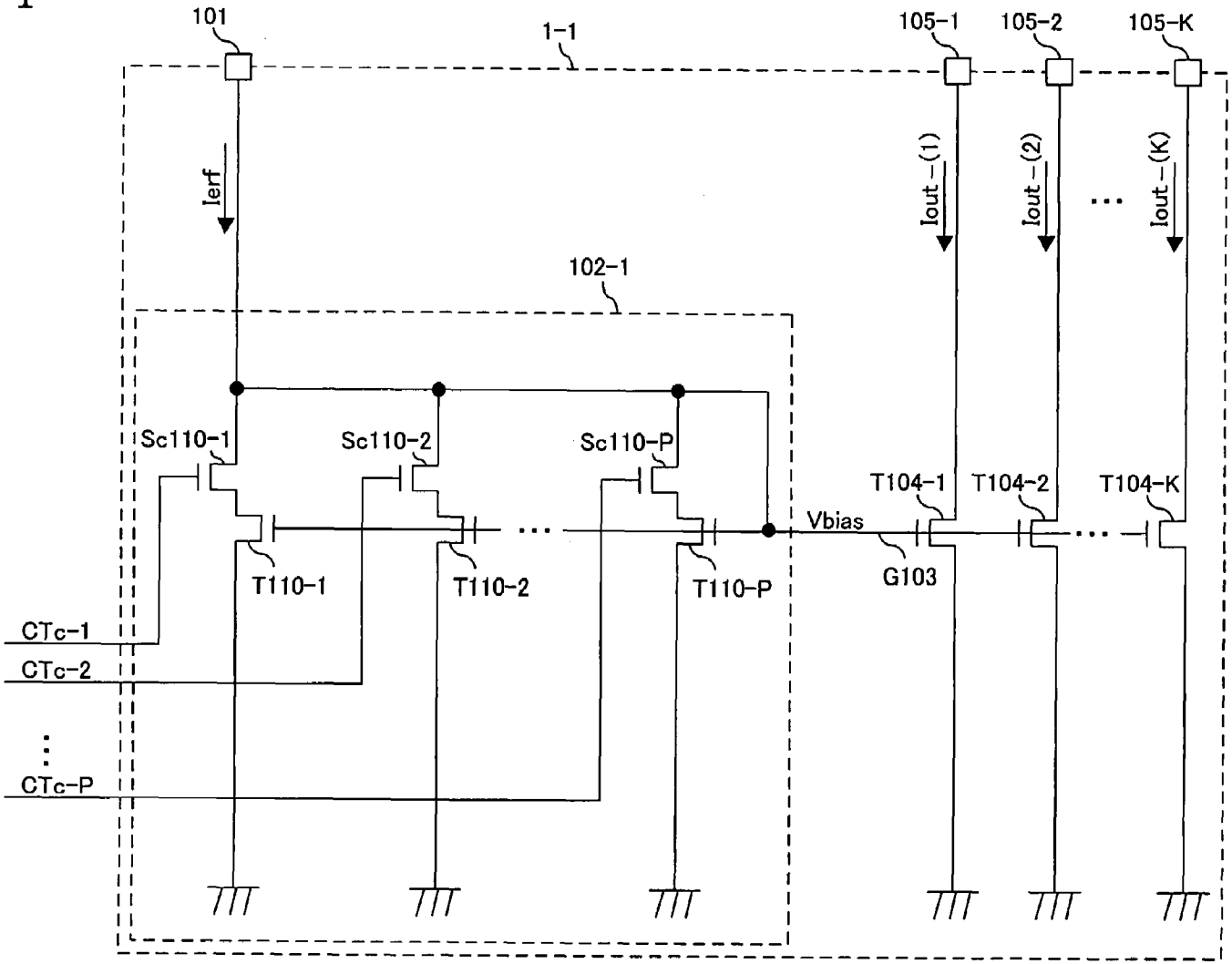
FIG. 4 is a diagram illustrating an exemplary internal configuration of a bias voltage generation section 102.

When the current driver 1 of FIG. 1 includes, instead of the bias voltage generation section 102 of FIG. 1, a bias voltage generation section 102-1 of FIG. 4, the same effects can be achieved. The bias voltage generation section 102-1 of FIG. 4 includes the voltage generation transistors T110-1 through T110-P of FIG. 1 and selection transistors Sc110-1 though Sc110-P. The voltage generation transistor T110-1 and the selection transistor Sc110-1 are connected in series between an input terminal 101 and a ground node. The selection transistor Sc110-1 is connected between the input terminal 101 and the voltage generation transistor T110-1 and receives a control signal CTc-1 from the outside at a gate thereof. The voltage generation transistor T110-1 is connected between the selection transistor Sc110-1 and the ground node and has a gate connected to a gate line G103. Each of the voltage generation transistors T110-2 through T110-P and an associated one of the selection transistors Sc110-2 through Sc110-P are connected in series between the input terminal 101 and a ground node in the same manner as the voltage generation transistor T110-1 and the selection transistor Sc110-1. Each of the selection transistors Sc110-2 through Sc110-P is connected between the input terminal 101 and the associated one of the voltage generation transistors T110-2 through T110-P in the same manner as the selection transistor Sc110-1 and receives an associated one of control signals CTc-2 through CTc-P at a gate thereof.

The control signals CTc-1 through CTc-P are voltages which activate the selection transistors Sc110-1 though Sc110-P (i.e., N-channel transistors), respectively, when being in the H level and negate the selection transistors Sc110-1 through Sc110-P (i.e., N-channel transistors), respectively, when being in the L level.

In the bias voltage generation section 102-1 of FIG. 4, the number of ones of the voltage generation transistors T110-1 though T110-P in which a gate and a drain are connected to each other and the reference current Iref is adjusted by the control signals CTc-1 through CTc-P.

Second Embodiment

<Overall Configuration>

Figure 5:
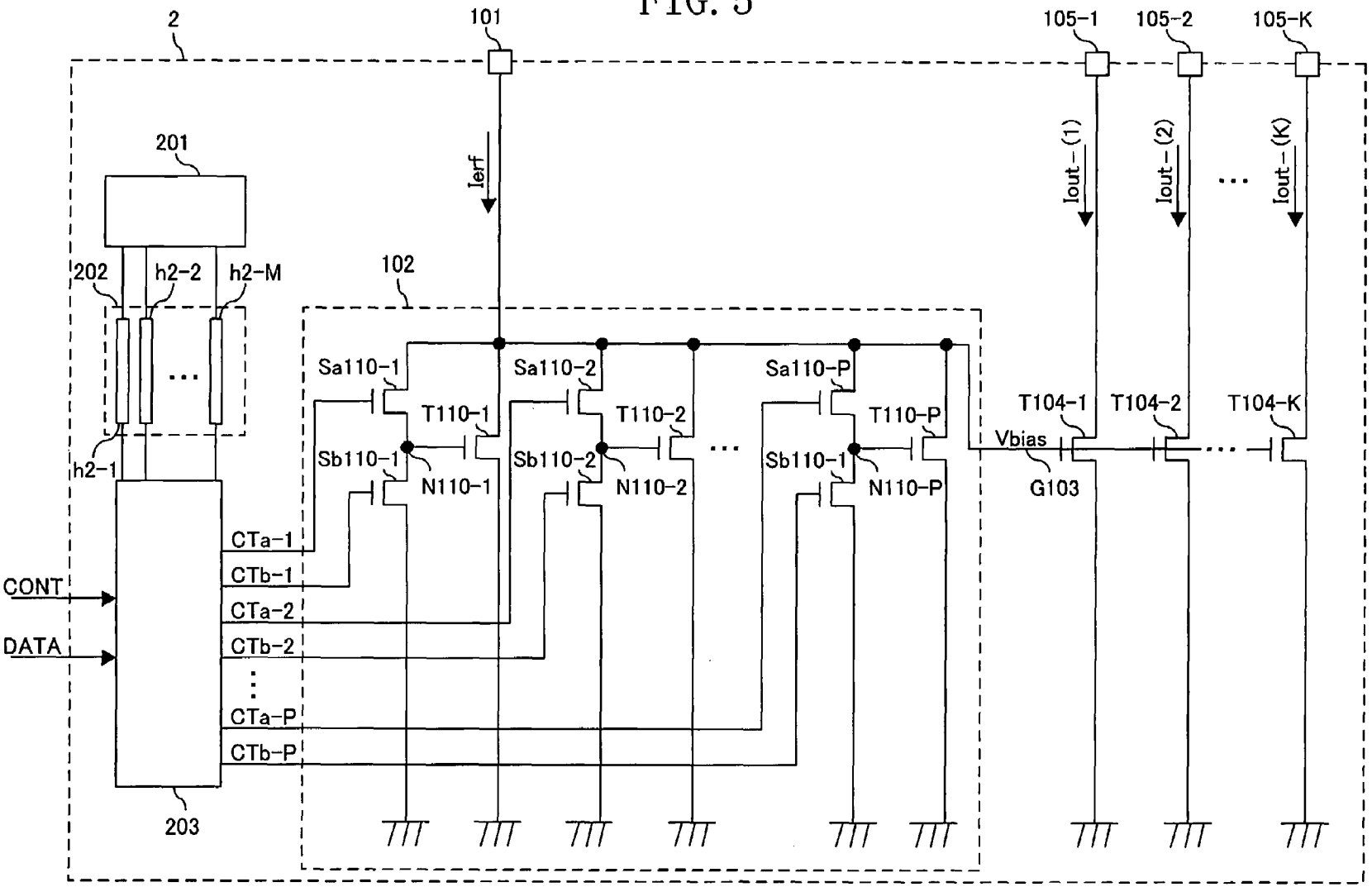
FIG. 5 is a diagram illustrating an overall configuration of a current driver according to a second embodiment of the present invention.

An overall configuration of a current driver according to a second embodiment of the present invention is shown in FIG. 5. A current driver 2 according to this embodiment includes, in addition to the components of the current driver 1 of FIG. 1, a supply power source 201, a condition storage section 202 and a control section 203.

The supply power source 201 supplies a read voltage to the condition storage section 202. The read voltage is a voltage indicating a connection state of the condition storage section 202. The control section 203 refers to the read voltage to check the connection state of the condition storage section 202.

The condition storage section 202 includes F fuses h2-1 through h2-F (where F is a natural number). Each of the fuses h2-1 through h2-F is made of a material capable of changing from a conductive state to a nonconductive state when being blown by application of a laser or a large current. With a state (i.e., blown or not blown) of each of the fuses h2-1 through h2-F expressed in terms of a binary system, the condition storage section 202 stores F bit binary data. In this case, the condition storage section 202 stores binary data indicating the number of transistors to be used out of the voltage generation transistors T110-1 though T110-P. For example, when a fuse h2-1 is blown and the other fuses h2-2 through h2-F are not blown, the condition storage section 202 stores that the number of transistors to be used is "one". Moreover, when the fuses h2-1 and h2-2 are blown and the other fuses h2-3 through h2-F are not blown, the condition storage section 202 stores that the number of transistors to be used is "three".

The control section 203 is turned to be a condition fixing mode or an emulation mode, according to a control signal CONT from the outside.

When the control section 203 enters a condition fixing mode, the control section 203 connects one terminal of each of the fuses h2-1 through h2-F to the control section 203 itself and reads out respective voltage levels indicated by the fuses h2-1 through h2-F. Thus, binary data expressed by states (i.e., blown or not blown) of the fuses is read out. Moreover, the control section 203 decodes the read-out binary data and outputs the control signals CTa-1 through CTa-P and the control signals CTb-1 though CTb-P. For example, when the fuses h2-1 and h2-2 are blown in the condition storage section 202 (i.e., binary data indicating that the number of transistors to be used is "three" is stored in the condition storage section 202), voltage levels indicated by the fuses h2-1 through h2-F are L, L, H, . . . and H. In this case, the control section 203 sets the control signals CTa-1 through CTa-3 and the control signals CTb-4 through CTb-P to be the H level, and the other control signals, i.e., the control signals CTa-4 through CTa-P and the control signals CTb-1 through CTb-3 to be the L level.

When the control section 203 enters an emulation mode, the control section 203 emulates states (i.e., blown or not blown) of the fuses h2-1 through h2-F in the condition storage section 202 according to the data signal DATA from the outside and outputs the control signals CTa-1 through CTa-P and the control signals CTb-1 through CTb-P. The data signal DATA is a signal for making the control section 203 emulate the states (i.e., blown or not blown) of the fuses in the condition storage section 202 (i.e., information stored in the condition storage section 202) and indicates F voltage levels according to the states (i.e., blown or not blown) of the fuses. For example, when the data signal DATA is for emulating a state where the fuse h2-1 is blown (i.e., a state where information indicating that the number of transistors to be used is "one" is stored in the condition storage section 202), F voltage levels indicated by the data signal DATA are L, H, H, . . . and H. In this case, the control section 203 sets the control signals CTa-1 and the control signals CTb-2 through CTb-P to be the H level, and other control signals, i.e., the control signals CTa-2 through CTa-P and the control signal CTb-1 to be the L level. Moreover, when the data signal DATA is for emulating a state where the fuses h2-1 and h2-2 are blown, F voltage levels indicated by the data signal DATA are L, L, H, . . . and H. In this case, the control section 203 sets the control signals CTa-1 through CTa-3 and the control signals CTb-4 and CTb-P to be the H level, and other control signals, i.e., the control signals CTa-4 through CTa-P and the control signals CTb-1 through CTb-3 to be the L level.

<Operation>

Next, the operation of the current driver 2 of FIG. 5 will be described.

[Setting Processing]

First, the current driver 2 is set to be either one of an operation state A and an operation state B in the same manner as the current driver 1 of FIG. 1.

Next, the control section 203 provided in the current driver 2 is operated, according to a control signal CONT from the outside.

<Emulation Mode>

When the control section 203 receives the control signal CONT instructing an emulation mode, the control section 203 becomes a state where the control section 203 is operated, according to the data signal DATA from the outside.

<<Operation State A>>

First, the case where the current driver 2 is set to be the operation state A will be described.

[Driving Processing]

When the current driver 2 is set to be the operation state A, the current driver 2 performs the same processing (i.e., driving processing (operation A)) as that of the current driver 1 of FIG. 1. Accordingly, the bias voltage generation section 102 generates a bias voltage Vbias having a voltage level corresponding to a current value of the reference current Iref supplied to the input terminal 101. Output terminals 105-1 through 105-K output the output currents Iout-(1) through Iout-(K) having current values corresponding to the voltage value of the bias voltage Vbias, respectively. It is assumed that the control section 203 receives a data signal DATA indicating a state where the fuses h2-1 and h2-2 are blown and outputs the control signals CTa-1 through CTa-P and the control signals CTb-1 through CTb-P to the bias voltage generation section 102. Thus, in this case, the control signals CTa-1 through CTa-3 and the control signals CTb-4 through CTb-P indicate the H level and the control signals CTa-4 through CTa-P and the control signals CTb-1 through CTb-3 indicate the L level.

[Current Value Measurement Processing]

Next, in the current driver 2, the same operation (i.e., current value measurement processing (operation state A)) as that of the current driver 1 of FIG. 1 is performed. Thus, a current value of the output current Iout-(K) output from the output terminal 105-K is measured.

[Characteristic Adjustment Processing]

Next, the control section 203 receives the data signal DATA corresponding to the current value of the output current Iout-(K) output from the output terminal 105-K. When the current value of the output current Iout-(K) is smaller than a desired current value (i.e., a reference value), the data signal DATA for reducing the number of voltage generation transistors to be used is supplied to the control section 203. For example, in this case, the data signal DATA indicating a state where the fuse h2-1 is blown (i.e., a state where information indicating that the number of voltage generation transistors to be used is "one" is stored in the condition storage section 202) is supplied. Moreover, when the current value of the output current Iout-(K) is larger than the desired current value (i.e., the reference value), the data signal DATA for increasing the number of voltage generation transistors to be used is supplied to the control section 203.

Next, the control section 203 outputs the control signals CTa-1 through CTa-P and the control signals CTb-1 through CTb-P corresponding to the data signal DATA to the bias voltage generation section 102. For example, when the data signal DATA indicating a state where the fuse h2-1 is blown is supplied, the control section 203 sets the control signal CTa-1 and the control signals CTb-2 through CTb-P to be the H level and the control signals CTa-2 through CTa-P and the CTb-1 to be the L level.

As described above, the number of ones of the voltage generation transistors T110-1 through T110-P in which a gate voltage is generated is adjusted. Thus, the voltage value of the bias voltage Vbias output from the bias generator 102 is increased/reduced. Specifically, when the value of the output current Iout-(K) is smaller than a reference value, the voltage value of the bias voltage Vbias is increased. When the current value of the output current Iout-(K) is larger than the reference value, the voltage value of the bias voltage Vbias is reduced.

Thus, when the current driver 2 is set to be the operation state A, the current value of the output current Iout-(K) output from the output terminal 105-K can be set to be the reference value.

<<Operation State B>>

Next, the case where the current driver 2 is set to be the operation state B will be described.

[Driving Processing]

When the current driver 2 is set to be the operation state B, the current driver 2 performs the same operation (i.e., driving processing (operation state B)) as that of the current driver 1. Accordingly, the bias voltage generation section 102 generates a bias voltage Vbias having a voltage value corresponding to the current value of the reference Iref supplied to the input terminal 101. The output terminals 105-1 through 105-K output the output currents Iout-(1) through Iout-(K) having current values corresponding to the voltage value of the bias voltage Vbias, respectively.

[Current Value Measurement Processing]

Next, in the current driver 2, the same operation (i.e., current value measurement processing (operation state B)) as that of the current driver 1 of FIG. 1 is performed. Thus, the current value of the output current Iout-(1) output from the output terminal 105-1 is measured.

[Characteristic Adjustment Processing]

Next, the control section 203 receives the data signal DATA corresponding to the current value of the output current Iout-(1) output from the output terminal 105-1. When the current value of the output current Iout-(1) is smaller than a desired current value (i.e., a reference value), the data signal DATA for reducing the number of voltage generation transistors to be used is supplied to the control section 203. Moreover, when the current value of the output current Iout-(1) is larger than the desired current value (i.e., the reference value), the data signal DATA for reducing the number of voltage generation transistors to be used is supplied to the control section 203.

Thus, when the current driver 2 is set to be the operation state B, the current value of the output current Iout-(1) output from the output terminal 105-1 can be set to be the reference value.

<Condition Fixing Mode>

When the control section 203 receives the control signal CONT for instructing a condition fixing mode, the control section 203 becomes a state where the control section 203 performs an operation on the bases of information stored in the condition storage section 202.

Next, the control section 203 connects one terminal of each of the fuses h2-1 through h2-F provided in the condition storage section 202 to the control section itself and reads out binary data represented by the states (i.e., blown or not blown) of the fuses.

Next, the control section 203 decodes the read-out binary data and outputs the control signals CTa-1 through CTa-P and the control signals CTb-1 through CTb-P to the bias voltage generation section 102.

Thus, respective output states of the control signals CTa-1 through CTa-P and the control signals CTb-1 through CTb-P stored in the condition storage section 202 are reproduced. Moreover, the output states are maintained.

<Current Driving Apparatus for Large-screen Display Panel>

Figure 6:
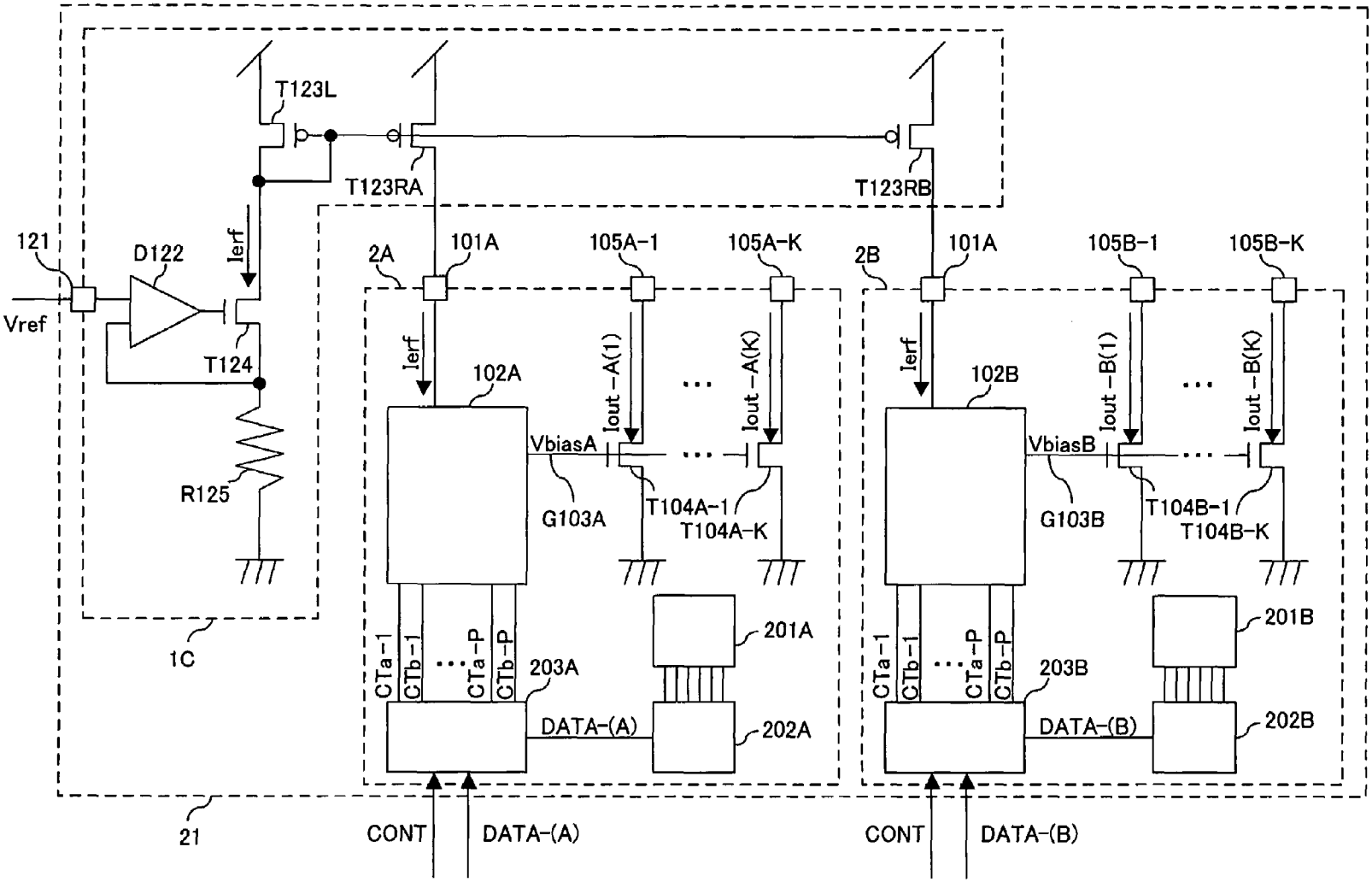
FIG. 6 is a diagram illustrating an overall configuration of a current driving apparatus according to the second embodiment of the present invention.

An overall configuration of a current driving apparatus 21 according to a second embodiment of the present invention is shown in FIG. 6. The current driving apparatus 21 includes, instead of the current drivers 1A and 1B of FIG. 2, current drivers 2A and 2B. Other than that, the configuration thereof is the same as that of FIG. 2. Each of the current drivers 2A and 2B has the same configuration as that of the current driver 2 of FIG. 5.

<Operation of Current Driving Apparatus>

Next, the operation of the current driving apparatus 21 of FIG. 6 will be described. In this case, the current driver 2A is set to be the operation state A and the current driver 2B is set to be the operation state B.

<Emulation Mode>

A control signal CONT is supplied to the current drivers 2A and 2B. Accordingly, each of the current drivers 2A and 2B enters an emulation mode.

[Current Driver 2A]

Next, the current driver 2A performs the same processing (i.e., driving processing) as that of the current driver 1A of FIG. 2. Accordingly, a bias voltage generation section 102A generates a bas voltage VbiasA having a voltage corresponding to a current value of a reference current Iref supplied to an input terminal 101A. Output terminals 105A-1 through 105A-K output output currents Iout-A(1) through Iout-A(K) having current values corresponding to a voltage value of the bias voltage VbiasA.

Next, in the current driver 2A, the same operation (i.e., current value measurement processing) as that of the current driver 1A of FIG. 2 is performed. Thus, a current value of the output current Iout-A(K) is measured.

[Current Driver 2B]

The current driver 2B performs the same processing (i.e., driving processing) as that of the current driver 1B of FIG. 2. Accordingly, a bias voltage generation section 102B generates a bias voltage VbiasB having a voltage value corresponding to a current value of a reference current Iref supplied to an input terminal 101B. Output terminals 105B-1 through 105B-K output output currents Iout-B(1) through Iout-B(K) having current values corresponding to a voltage value of the bias voltage VbiasB, respectively.

Next, in the current driver 2B, the same operation (i.e., current value measurement processing) as that of the current driver 1B of FIG. 2 is performed. Thus, a current value of the output current Iout-B(1) is measured.

[Current Driver 2A]

Next, the current driver 2A performs the same operation (i.e., characteristic adjustment processing) as that of the current driver 1A of FIG. 2. Specifically, the control section 203A of the current driver 2A newly receives a data signal DATA-(A) corresponding to the measured current value of the output current Iout-A(K). Thus, the voltage value of the bias voltage VbiasA output from the bias voltage generation section 102A to a gate line G103A is increased/reduced, so that respective current values of output currents Iout-A(1) through Iout-A(K) flowing in driving transistors T104A-1 through T104A-K are adjusted.

[Current Driver 2B]

The current driver 2B performs the same operation (i.e., characteristic adjustment processing) as that of the current driver 1B of FIG. 2. Specifically, the control section 203B of the current driver 2B newly receives a data signal DATA-(B) corresponding to the measured current value of the output current Iout-(1). Thus, the voltage value of the bias voltage VbiasB output from the bias voltage generation section 102B to the gate line G103B is increased/reduced, so that respective current values of the output currents Iout-B(1) through Iout-B(K) flowing in the driving transistors T104B-1 through T104B-K are adjusted.

As described above, the data signals DATA-(A) and DATA-(B) received by the control sections 203A and 203B, respectively, are adjusted, according to the current value of the output current Iout-A(K) flowing in the driving transistor T104A-K (or the current value of the output current Iout-B (1) flowing in the driving transistor T104B-1). Thus, as shown in FIG. 3B, the current value of the output current Iout-A(K) of the current driver 2A and the current value of the output current Iout-B(1) of the current driver 2B can be made to match each other.

<Condition Fixing Mode>

A control signal CONT for instructing a condition fixing mode is supplied to each of the current drivers 2A and 2B. Accordingly, each of the current drivers 2A and 2B becomes a condition fixing mode.

Next, the control section 203A provided in the current driver 2A reads the data signal DATA-(A) corresponding to information stored in the condition storage section 202A. Next, the control section 203A outputs the control signals CTa-1 through CTa-P and the control signals CTb-1 through CTb-P corresponding to the read-out data signal DATA-(A) to the bias voltage generation section 102A.

The control section 203B provided in the current driver 2B reads the data signal DATA-(B) corresponding to information stored in the condition storage section 203B. Next, the control section 203B outputs the control signals CTa-1 through CTa-P and the control signals CTb-1 through CTb-P corresponding to the read-out data signal DATA-(B) to the bias voltage generation section 102B.

Thus, respective current-voltage conversion capabilities of the bias voltage generators 102A and 102B can be set to correspond to information stored in the condition storage sections 202A and 202B, respectively.

<Effects>

As has been described above, in an emulation mode, a performance (i.e., current-voltage conversion capability) of the bias voltage generation section 102 is adjusted by the control section 203, so that a current driver can be operated under the condition where respective states of the output currents Iout-(1) through Iout-(K) flowing in the driving transistors T104-1 through T104-K are optimized.

Moreover, in a condition fixing mode, the control section 203 reads out information stored in the condition storage section 202. Therefore, it is not necessary to supply the control signals CTa-1 through CTa-P and the control signals CTb-1 through CTb-P from the outside. Accordingly, for example, it becomes unnecessary to supply the data signal DATA from the outside to the control section 203 after the driving current driver 2 is mounted on a display panel or the like.

Furthermore, if the fuses h2-1 through h2-F provided in the condition storage section 202 are blown on the basis of results of emulation and thereby respective output states of the control signals CTa-1 through CTa-P and the control signals CTb-1 through CTb-P are stored, conditions when output currents Iout are in optimum states are maintained.

Alternatively, the control section 203 may be operated with a condition fixing mode used as a default. That is, the control section 203 may be a condition fixing mode at all the time, except for when being in an emulation mode.

Alternatively, to reduce the number of fuses actually blown, a setting with which the number of fuses to be blown increases on the basis of the conditions when the output currents Iout-(1) through Iout-(K) are in optimum states may be used. For example, suppose that the output currents Iout-(1) through Iout-(K) are in optimum states when three of the voltage generation transistors T110-1 through T110-P are used. The condition control section 203 decodes binary data stored in the condition storage section 202 such that the control signals CTa-1 through CTa-3 and the control signals CTb-4 through CTb-P become the H level and the control signals CTa-4 through CTa-P and the control signals CTb-1 through CTb-3 become the L level when respective voltage levels indicated by the fuses h2-1 through h2-F are H, H, H, . . . and H.

Third Embodiment

<Overall Configuration>

Figure 7:
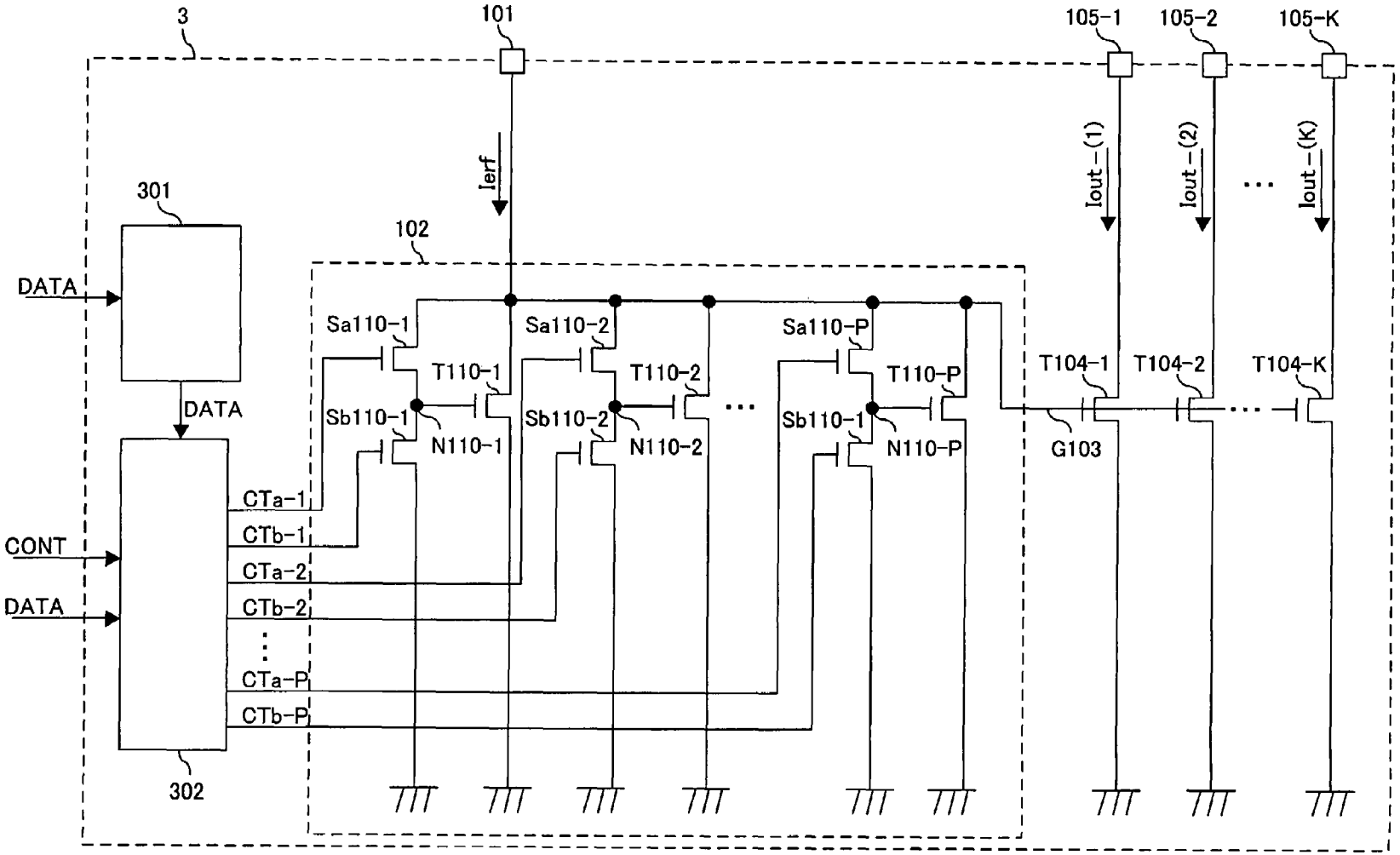
FIG. 7 is a diagram illustrating an overall configuration of a current driver according to a third embodiment of the present invention.

An overall configuration of a current driver 3 according to a third embodiment of the present invention is shown in FIG. 7. The current driver 3 includes, in addition to the components of the current driver 1 of FIG. 1, a storage section 301 and a control section 303. The storage section 301 is a rewritable memory such as a DRAM (dynamic random access memory) and a SRAM (static random access memory). The data signal DATA from the outside is written in the storage section 301. The control section 302 reads out the data signal DATA written in the storage section 301 and outputs the control signals CTa-1 through CTa-P and the control signals CTb-1 through CTb-P corresponding to the read-out data signal DATA to the bias voltage generation section 102.

<Operation>

Next, the operation of the current driver 3 of FIG. 7 will be described. Except for the operations of the storage section 301 and the control section 302, the operation of the current driver 3 is the same as the operation of the current driver 2 of FIG. 5.

[Emulation Mode]

In an emulation mode, the control section 302 outputs the control signals CTa-1 through CTa-P and the control signals CTb-1 through CTb-P corresponding to the data signal DATA input from the outside.

[Condition Fixing Mode]

In a condition fixing mode, the control section 302 outputs the control signals CTa-1 through CTa-P and the control signals CTb-1 through CTb-P corresponding to the data signal DATA stored in the storage section 301.

<Effects>

As has been described above, the data signal DATA stored in the storage section 301 can be appropriately rewritten, so that the conditions when the output currents Iout-(1) through Iout-(K) are in optimum states can be maintained. For example, when the respective current values of the output currents Iout-(1) through Iout-(K) are changed due to change in transistors characteristics of the driving transistors T104-1 through T104-K, emulation is performed again and the information stored in the storage section 301 is rewritten, according to a result of the emulation. Thus, the conditions when the output currents Iout-(1) through Iout-(K) are in optimum states can be maintained.

Fourth Embodiment

<Overall Configuration>

Figure 8:
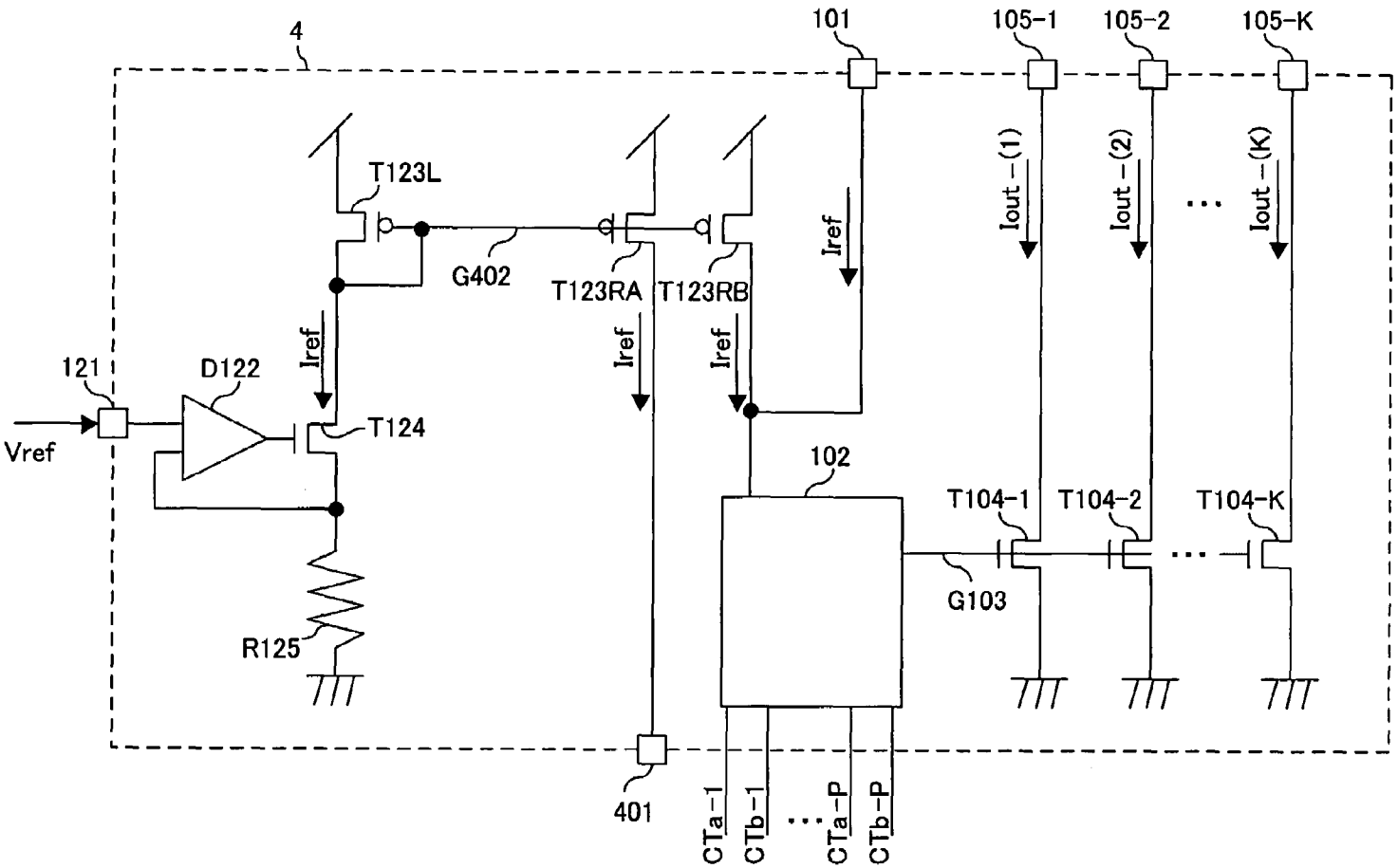
FIG. 8 is a diagram illustrating an overall configuration of a current driver according to a fourth embodiment of the present invention.

An overall configuration of a current driver 4 according to a fourth embodiment of the present invention is shown in FIG. 8. The current driver 4 includes, in addition to the components of the current driver 1, an output terminal 401, an input terminal 121, a differential amplifier circuit D122, a setting transistor T123L, supply transistors T123RA and T123RB, an adjusting transistor T124 and a load resistance R125. The connection relationship among the input terminal 121, the differential amplifier circuit D122, the setting transistor T123L, the adjusting transistor T124 and the load resistance R125 is the same as that of FIG. 2. The supply transistor T123RA is connected between a power supply node and the output terminal 401. The supply transistor T123RB is connected between a power supply node and a bias voltage generation section 102. Each of a gate of the setting transistor T123L and respective gates of the supply transistors T123RA and T123RB is connected to a gate line G402.

<Operation>

Next, the operation of the current driver 4 of FIG. 8 will be described.

[Setting Processing]

First, the current driver 4 is set to be either one of a master or a slave.

<<Master>>

When the current driver 4 is set to be a master, the input terminal 121 receives a reference voltage Vref from the outside. A voltage-current conversion circuit formed of the differential amplifier circuit D122, the adjusting transistor T124 and the load resistance R125 generates a reference current Iref having a current value corresponding to a voltage value of the reference voltage Vref supplied to the input terminal 121. Accordingly, the reference current Iref flows in the setting transistor T123L.

Next, a current mirror circuit formed of the setting transistor T123L and the supply transistor T123RB supplies the reference current Iref to the bias voltage generation section 102. Accordingly, the bias voltage generation section 102 outputs a bias voltage Vbias corresponding to the current value of the reference current Iref supplied from the supply transistor T123L to a gate line G103. Thus, output currents Iout-(1) through Iout-(K) corresponding to a voltage value of the bias voltage Vbias flow in the driving transistors T104-1 through T104-K, respectively. Next, output terminals 105-1 through 105-K output the output currents Iout-(1) through Iout-(K) flowing in the driving transistors T104-1 through T104-K, respectively.

Next, the same processing (i.e., current value measurement processing and characteristic adjustment processing) as that of the current driver 1 of FIG. 1 (in the operation state A) is performed.

A current mirror circuit formed of the setting transistor T123L and the supply transistor T123RA supplies the reference current Iref to the output terminal 401.

<<Slave>>

When the current driver 4 is set to be a slave, the input terminal 101 receives the reference current Iref from the outside. The bias voltage generation section 102 receives the reference current Iref supplied to the input terminal 101. Accordingly, the bias voltage generation section 102 outputs the bias voltage Vbias corresponding to the current value of the reference current Iref supplied to the input terminal 101 to the gate line G103. Thus, the output currents Iout-(1) through Iout-(K) corresponding to the voltage value of the bias voltage Vbias flow in the driving transistors T104-1 through T104-K, respectively. Next, the output terminals 105-1 through 105-K outputs the output currents Iout-(1) through Iout-(K) flowing in the driving transistors T104-1 through T104-K.

Next, the same process (i.e., current value measurement processing and characteristic adjustment processing) as that of the current driver 1 of FIG. 1 (in the operation state B) is performed.

<Current Driving Apparatus for Large-scale Display Panel>

Figure 9:
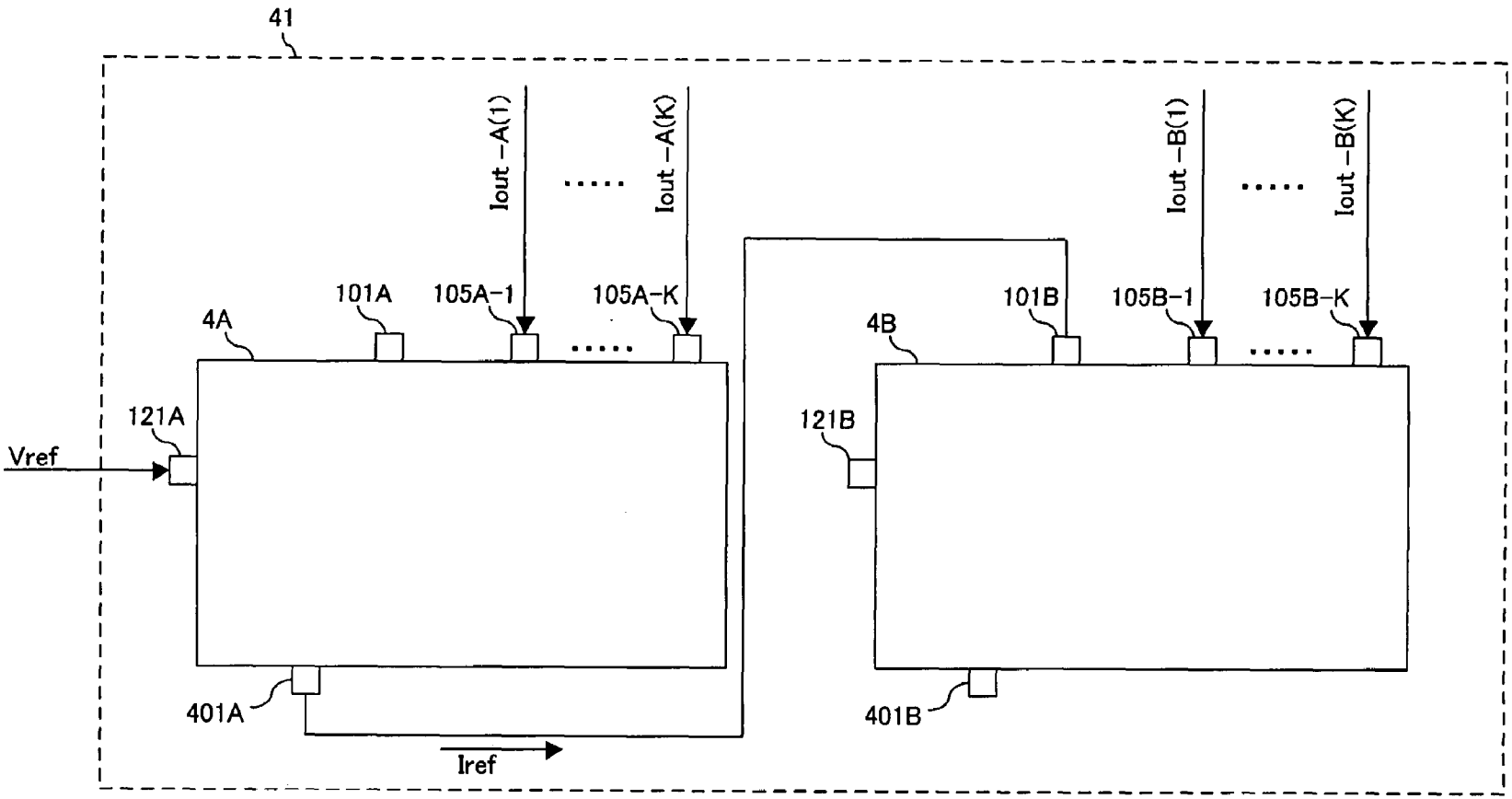
FIG. 9 is a diagram illustrating an overall configuration of a current driving apparatus according to the fourth embodiment of the present invention.

An overall configuration of a current driving apparatus 41 according to the fourth embodiment of the present invention is shown in FIG. 9. The current driving apparatus 41 includes current drivers 4A and 4B. Each of the current drivers 4A and 4B has the same configuration as the configuration of the current driver 4 of FIG. 8. The current driver 4A is set to be a master. In the current driver 4A, the reference voltage Vref is supplied to the input terminal 121A from the outside. On the other hand, the current driver 4B is set to be a slave. In the current driver 4B, an input terminal 101B is connected to an output terminal 401A of the current driver 4A. In FIG. 9, control signals CTa-1 through CTa-P and control signals CTb-1 through CTb-P supplied to each of the current drivers 4A and 4B are omitted.

<Operation>

Next, the operation of the current driving apparatus 41 of FIG. 9 will be described.

[Current Driver 4A]

The current driver 4A is set to be a master. Accordingly, the input terminal 121A receives the reference voltage Vref from the outside. The reference current Iref is not supplied to an input terminal 101A.

Next, in the current driver 4A, the same processing (i.e., driving processing, current value measurement processing and characteristic adjustment processing) as that of the current driving apparatus 4 (as a master) of FIG. 4 is performed. Accordingly, the bias voltage generation section 102 provided in the current driver 4A receives the reference current Iref corresponding to the voltage value of the reference voltage Vref supplied to the input terminal 121A from the supply transistor T123RB and outputs the bias voltage Vbias corresponding to the current value of the reference current Iref to the gate line G103. Moreover, the output terminals 105A-1 through 105A-K output output currents Iout-A(1) through IoutA-(K) corresponding to the voltage value of the bias voltage Vbias generated by the bias voltage generation section 102 provided in the current driver 4A, respectively. Furthermore, the bias voltage generation section 102 provided in the current driver 4A receives the control signals CTa-1 through CTa-P and the control signals CTb-1 through CTb-P corresponding to a current value of the output current Iout-A(K).

Moreover, the output terminal 401A outputs the reference current Iref corresponding to the voltage value of the reference voltage Vref supplied to the input terminal 121A to an input terminal 101B of the current driver 4B.

[Current Driving Apparatus 4B]

The current driving apparatus 4B is set to be a slave. Accordingly, the input terminal 121B does not receive the reference voltage Vref. The input terminal 101B receives the reference current Iref output from the output terminal 401 of the current driver 4A.

Next, in the current driver 4B, the same processing (i.e., driving processing, current value measurement processing and characteristic adjustment processing) as that of the current driver 4 (as a slave) of FIG. 4 is performed. Accordingly, the bias voltage generation section 102 provided in the current driver 4B receives the reference current Iref output from an output terminal 401B of the current driver 4B and outputs the bias voltage Vbias corresponding to the current value of the reference current Iref to the gate line G103. Moreover, output terminals 105B-1 through 105B-K output output currents Iout-B(1) through Iout-B(K) corresponding to the voltage value of the bias voltage Vbias generated by the bias voltage generation section 102 provided in the current driver 4B, respectively. Furthermore, the bias voltage generation section 102 provided in the current driver 4B receives the control signals CTa-1 through CTa-P and the control signals CTb-1 through CTb-P corresponding to the current value of the output current Iout-B(1).

<Effects>

As has been described above, the current driver 4 can be operated as a master and also operated as a slave. That is, a master and a slave can be formed in a single fabrication process. Thus, characteristic variation between chips caused in fabrication can be reduced.

Fifth Embodiment

<Overall Configuration>

Figure 10:
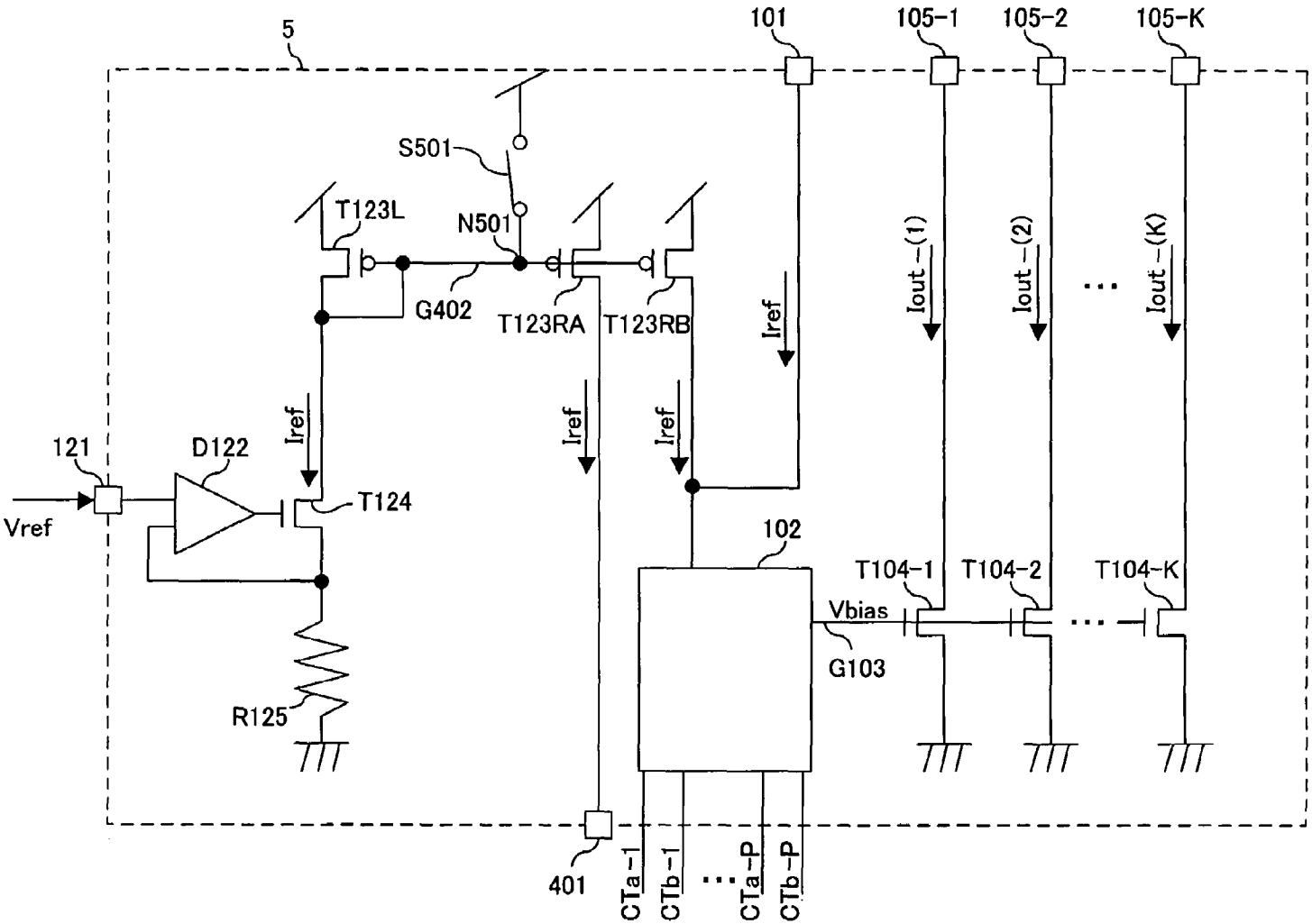
FIG. 10 is a diagram illustrating an overall configuration of a current driver according to a fifth embodiment of the present invention.

An overall configuration of a current driver 5 according to a fifth embodiment of the present invention is shown in FIG. 10. The current driver 5 includes, in addition to the components of the current driver 4 of FIG. 8, a switch S501. The switch S501 is connected between a power supply node and a node N501. The node N501 is provided in an arbitrary point on a gate line G402.

<Operation>

Next, the operation of the current driver 5 of FIG. 10 will be described. Except for the operation of the switch S501, the operation of the current driver 5 is the same as the operation of the current driver 4 of FIG. 8.

<<Master>>

When the current driver 5 is set to be a master, the switch S501 is turned OFF. Accordingly, a potential of the gate line G402 becomes the same potential as that of a gate of the setting transistor T123L, and each of the supply transistors T123RA and T123RB receives a gate voltage generated in the gate of the setting transistor T123L at a gate thereof. Thus, the reference current Iref flows in each of the supply transistors T123RA and T123RB. That is, the setting transistor T123L and the supply transistors T123RA and T123RB together function as a current mirror circuit.

<<Slave>>

When the current driver 5 is set to be a slave, the switch S501 is turned ON. Accordingly, the potential of the gate line G402 becomes the same potential as that of a power supply node. Then, potentials of a gate and a source of the setting transistor T123L become the same and potentials of a gate and a source of each of the supply transistors T123RA and T123RB become the same. Thus, the setting transistor T123L and the supply transistors T123RA and T123RB do not function as a current mirror circuit.

<Effects>

As has been described above, when the current driver 5 is set to be a slave, unnecessary current flow in the supply transistors T123RA and T123RB can be prevented. Thus, when the current driver 5 is set to be a slave, misoperation of the bias voltage generation section 102 due to unnecessary current flow from the supply transistor T123RB can be prevented.

Sixth Embodiment

<Overall Configuration>

Figure 11:
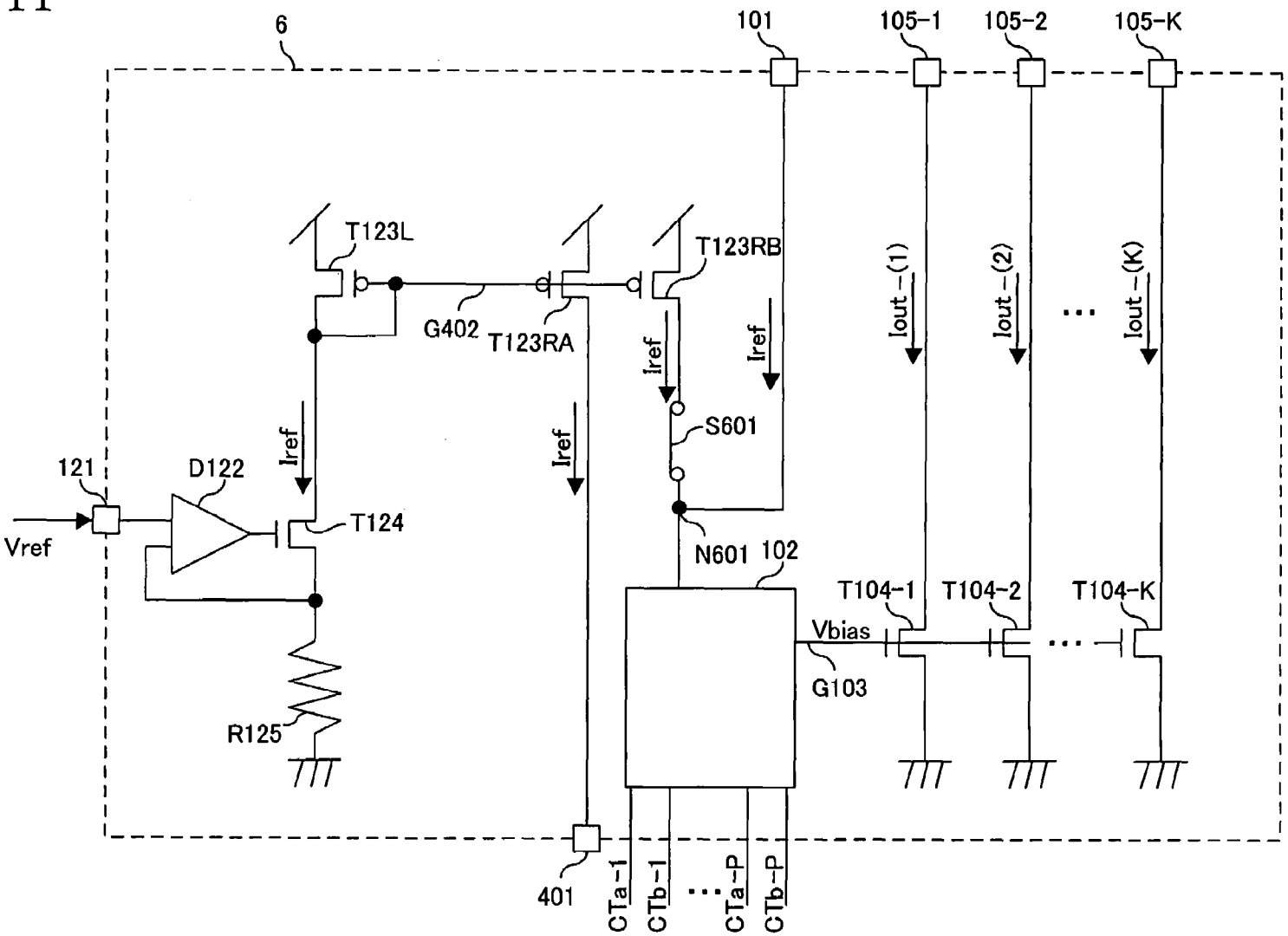
FIG. 11 is a diagram illustrating an overall configuration of a current driver according to a sixth embodiment of the present invention.

An overall configuration of a current driver 6 according to a sixth embodiment of the present invention is shown in FIG. 11. The current driver 6 includes, in addition to the components of the current driver 4 of FIG. 8, a switch S601. The switch S601 is connected between a supply transistor T123RB and a node N601. The node N601 is provided between a setting transistor T123L and a bias voltage generation section 102. An input terminal 101 is connected to a node N601.

<Operation>

Next, the operation of the current driver 6 of FIG. 11 will be described. Except for the operation of the switch S601, the operation of the current driver 6 is the same as the operation of the current driver 4 of FIG. 8.

<<Master>>

When the current driver 6 is set to be a master, the switch S601 is turned ON. Accordingly, a drain of the supply transistor T123RB and the bias voltage generation section 102 are connected to each other. Moreover, the input terminal 101 does not receive a reference current Tref. Therefore, the bias voltage generation section 102 receives the reference current Iref supplied from the supply transistor T123RB.

<<Slave>>

When the current driving apparatus 6 is set to be a slave, the switch S601 is turned OFF. Accordingly, the drain of the supply transistor T123RB and the bias voltage generation section 102 are not connected to each other. Moreover, the input terminal 101 receives the reference current Iref from the outside (a master). Therefore, the bias voltage generation section 102 receives the reference current Iref supplied to the input terminal 101.

<Effects>

As has been described, when the current driver 6 is set to be a slave, the connection of the supply transistor T123RB and the bias voltage generation section 102 is cut off. Thus, when the current driver 6 is set to be a slave, misoperation of the bias voltage generation section 102 due to unnecessary current flow from the supply transistor T123RB can be prevented.

Figure 12:
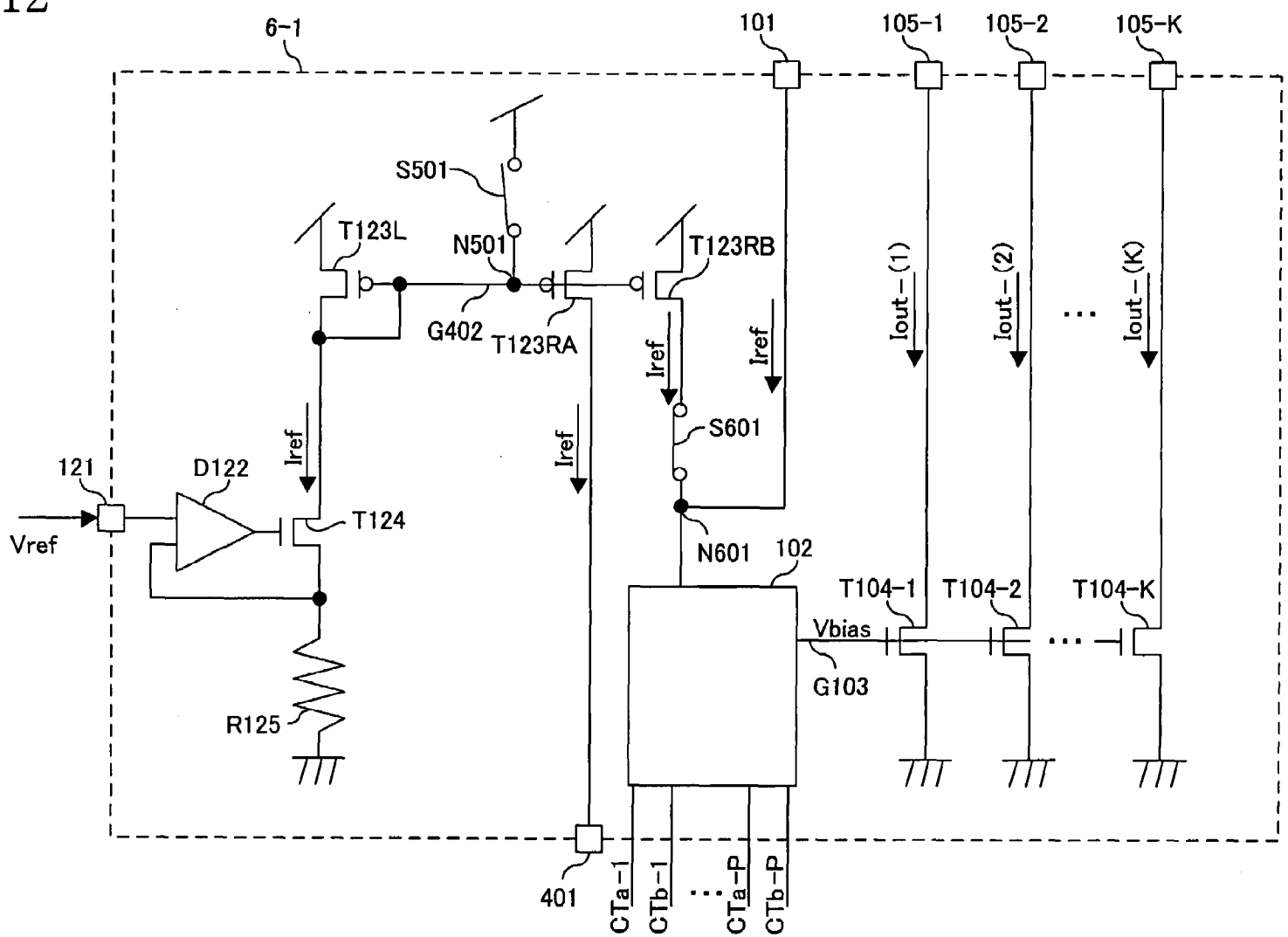
FIG. 12 is a diagram illustrating an overall configuration of a current driver according to a modified example of the sixth embodiment of the present invention.

The switch S501 of FIG. 10 can be added to the current driver 6 of FIG. 11. An overall configuration of a current driver 6-1 according to a modified example of the sixth embodiment of the present invention is shown in FIG. 12. The current driver 6-1 includes, in addition to the components of the current driver 4 of FIG. 8, the switch S501 of FIG. 10 and the switch 601 of FIG. 11. With the current driver 6-1 configured in the above-described manner, reliable switching processing can be performed.

Seventh Embodiment

<Overall Configuration>

Figure 13:
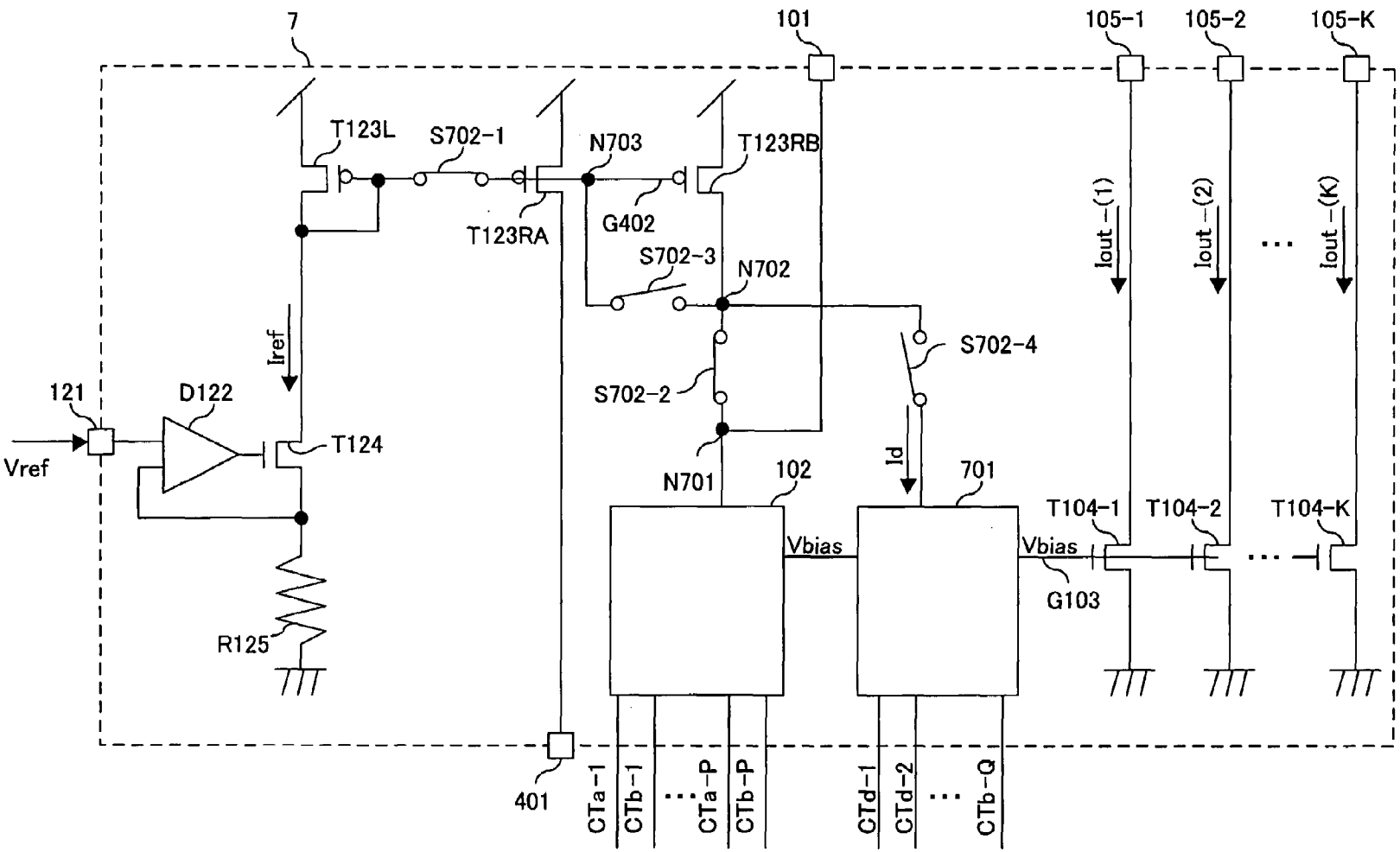
FIG. 13 is a diagram illustrating an overall configuration of a current driver according to a seventh embodiment of the present invention.

An overall configuration of a current driver 7 according to a seventh embodiment of the present invention is shown in FIG. 13. The current driver 7 includes, in addition to the components of the current driver 4 of FIG. 8, a drain current generation section 701 and switches S702-1 through S702-4.

The drain current generation section 701 generates a drain current Id having a current value corresponding to a voltage value of a bias voltage Vbias output from the bias voltage generation section 102. Moreover, the drain current generation section 701 can arbitrarily set the relationship (voltage-current conversion capacity) between a voltage value of a bias voltage received by the drain current generation section 701 itself and a current value of the drain current Id generated by the drain current generation section 701 itself.

The switch S702-1 is connected between a gate of the setting transistor T123L and a supply transistor T123RA. The switch S702-2 is connected between a node N701 and a node N702. The node N701 is provided between the supply transistor T123RB and the bias voltage generation section 102 and is connected to an input terminal 101. The node N702 is provided between the supply transistor T123RB and the node N701. The switch S702-3 is connected between the node N702 and the node N703. The node N703 is provided in an arbitrary location between the switch S702-1 and the supply transistor T123RB on a gate line G402. The switch S702-4 is connected between the node N702 and the drain current generation section 701.

<Internal Configuration of Drain Current Generation Section 701>

Figure 14:
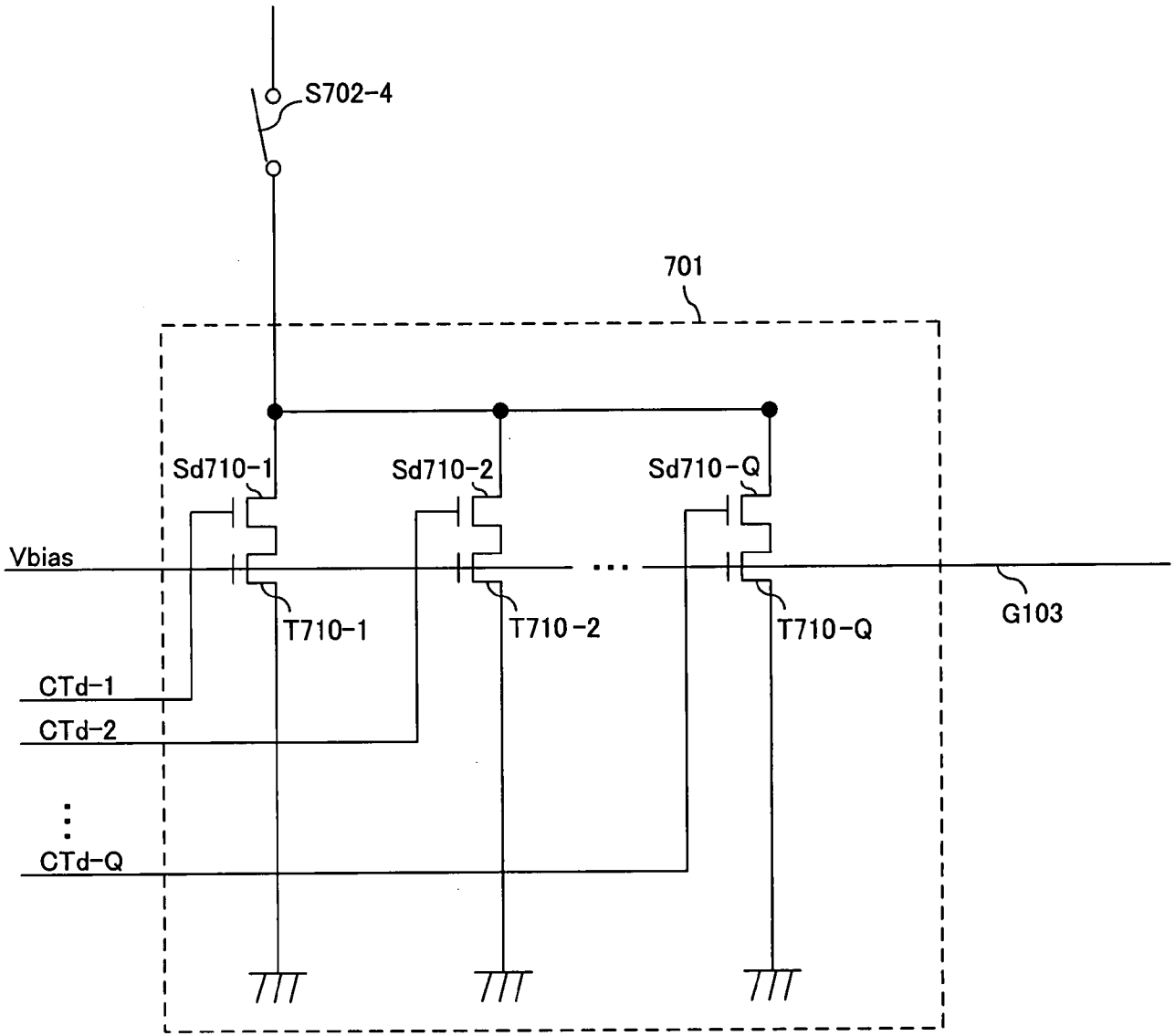
FIG. 14 is a diagram illustrating an internal configuration of a drain current generation section shown in FIG. 13.

An internal configuration of the drain current generation section 701 of FIG. 13 is shown in FIG. 14. The drain current generation section 701 includes Q current generator transistors T710-1 through T710-Q and Q selection transistors Sd710-1 through Sd701-Q (where Q is a natural number). The selection transistor Sd710-1 and the current generator transistor T710-1 are connected in series between a switch S702-4 and a ground node. The selection transistor Sd710-1 is connected between the switch S702-4 and the current generator transistor T710-1 and receives a control signal CTd-1 from the outside at a gate thereof. The current generator transistor T710-1 is connected between the selection transistor Sd710-1 and a ground node and has a gate connected to a gate line G103. Each of the selection transistors Sd710-2 through Sd710-Q and an associated one of the current generator transistors T710-2 through T710-Q are connected in series between the switch S702-4 and a ground node in the same manner and the selection transistor Sd710-1 and the current generator transistor T710-1. Each of the selection transistors Sd710-2 through Sd710-Q is connected between the switch S702-4 and the associated one of the current generator transistors T710-2 through T710-Q in the same manner as the selection transistor Sd710-1 and receives control signals CTd-2 through CTd-Q from the outside at a gate thereof. Each of the current generator transistors T710-2 through T710-Q is connected between an associated one of the selection transistors Sd710-2 through Sd710-Q in the same manner as the current generator transistor T710-1 and has a gate connected to the gate line G103.

The control signals CTd-1 through CTd-Q are voltages which activate the selection transistors Sd710-1 through Sd710-Q (i.e., N-channel transistors), respectively, when being the H level and negate the selection transistors Sd710-1 through Sd710-Q (i.e., N-channel transistors), respectively, when being the L level.

As described above, the bias voltage generation section 102 and the drain current generation section 701 together form a current mirror circuit of which a mirror ratio can be arbitrarily set.

In this case, it is assumed that the current generator transistors T110-1 through T110-Q provided in the bias voltage generation section 102 exhibit the same or substantially the same transistor characteristics, and the current generator transistors T710-1 through T710-Q provided in the drain current generation section 701 exhibit the same or substantially the same transistor characteristics.

<Operation>

Next, the operation of the current driver 7 of FIG. 13 will be described.

[Setting Processing]

First, the current driver 7 is set to be one of a master, a slave (1) and a slave (2).

<<Master>>

When the current driver 7 is set to be a master, the switches S702-1 and S702-2 are turned ON and the switches S702-3 and S702-4 are turned OFF. Moreover, the input terminal 121 receives the reference voltage Vref from the outside. The input terminal 101 does not receive the reference current Iref from the outside.

With the switch S702-1 turned ON, the gate of the setting transistor T123L is connected to each of the respective gates of the supply transistors T123RA and T123RB. Moreover, with the reference voltage Vref supplied to the input terminal 121, the reference current Iref flows in the setting transistor T123L and the supply transistors T123RA and T123RB. Accordingly, an output terminal 401 outputs the reference current Iref flowing in the supply transistor T123RA.

Moreover, with the switch S702-2 turned ON, the supply transistor T123RB and the bias voltage generation section 102 are connected to each other. Accordingly, the bias voltage generation section 102 outputs the bias voltage Vbias corresponding to the current value of the reference current Iref supplied from the supply transistor T123RB to a gate line G103. Thus, output currents Iout-(1) through Iout(K) corresponding to the voltage value of the bias voltage Vbias flow in the driving transistors T104-1 through T104-K, respectively. Next, output terminals 105-1 through 105-K output the output currents Iout-(1) through Iout-(K) flowing in the driving transistors T104-1 through T104-K, respectively.

Next, the same processing (i.e., current value measurement processing and characteristic adjustment processing) as that of the current driver 4 (as a master) of FIG. 8 is performed.

As has been described above, the current value of the output current Iout-(K) is adjusted to be the reference value.

<<Slave (1)>>

When the current driver 7 is set to be a slave, the switches S702-1 and S702-2 are turned OFF and the switches S702-3 and S702-4 are turned ON. Moreover, the input terminal 121 does not receive the reference voltage Vref The input terminal 101 receives the reference current Iref from the outside.

With the reference current Iref supplied to the input terminal 101, the bias voltage generator 102 outputs a bias voltage corresponding to the current value of the reference current Iref supplied to the input terminal 101 to the gate line G103. Thus, the output currents Iout-(1) through Iout-(K) corresponding to the voltage value of the bias voltage Vbias flow in the driving transistors T104-1 through T104-K, respectively. Next, the output terminals 105-1 through 105-K output the output currents Iout-(1) through Iout-(K), respectively.

Moreover, with the switch S702-3 turned ON, the drain current generation section 701 and a drain of the supply transistor T123RB are connected to each other. Accordingly, the drain current Id generated by the drain current generation section 701 flows in the supply transistor T123RB.

With the switch S702-4 turned ON, a gate and a drain of the supply transistors T123RB are connected to each other. Thus, the supply transistor T123RB and the supply transistor T123RA together form a current mirror circuit. Moreover, the supply transistors T123RA and T123RB exhibit the same or substantially the same transistor characteristics. Thus, the drain current Id (a drain current having the same or substantially the same current value as the drain current Id flowing in the supply transistor T123RB) flows in the supply transistor T123RA. Accordingly, the output terminal 401 outputs the drain current Id flowing in the setting transistor T123RA.

Next, the same processing (i.e., current value measurement processing and characteristic adjustment processing) as that of the current driver 4 (as a slave) of FIG. 8 is performed and the bias voltage generation section 102 receives control signals CTa-1 through CTa-P and control signals CTb-1 through CTb-P.

<<Slave (2)>>

Moreover, when the current driver 7 is set to be a slave (2), the same operation as the operation of the current driver 7 being set to be the slave (1) is performed. Accordingly, the switches S702-1 and S702-2 are turned OFF and the switches S702-3 and S702-4 are turned ON. Moreover, the input terminal 121 does not receive the reference voltage Vref. The input terminal 101 receives the reference current Iref from the outside. Furthermore, when being set to be the slave (2), the current driver 7 performs drain current control for controlling the current value of the drain current Id output from the output terminal 401.

[Drain Current Adjustment Processing]

Next, the number of ones of the current generator transistors T710-1 through T710-Q which are provided in the drain current generation section 701 and in which a drain is connected to the node N701 is adjusted such that the mirror ratio of the current mirror circuit formed of the bias voltage generation section 102 and the drain current generation section 701 becomes 1:1. For example, the number of ones of the voltage generation transistors T110-1 through T110-P which are provided in the bias voltage generation section 102 and in which a gate and a drain thereof are connected and the reference current Iref flows is "five", the number of ones of the current generator transistors T710-1 through T710-Q which are provided in the drain current generation section 701 and in which a drain is connected to the node N701 is set to be "five".

Next, the output value of the output current Iout-(K) output from the output terminal 105-K is measured.

Next, the drain current generation section 701 receives the control signals CTd-1 through CTd-Q corresponding to a difference between the current value of the output current Iout-(1) and the current value of the output current Iout-(K). In this case, when the current value of the output current Iout-(K) is twice as large as the current value of the output current Iout-(1), the control signals CTd-1 through CTd-Q for instructing that the number of ones of the current generator transistors T710-1 through T710-Q connected to the node N701 is twice as large as the number of ones of the voltage generation transistors T110-1 through T110-P in which a gate and a drain thereof are connected are supplied. For example, the control signals CTa-1 through CTa-5 and the control signals CTb-6 through CTb-P supplied to the bias voltage generation section 102 are the H level and the control signals CTa-6 through CTa-P and the control signals CTb-1 through CTb-5 are the L level, the control signals CTd-1 through CTd-10 supplied to the drain current generation section 701 are the H level and the control signals CTb-11 through CTd-Q are the L level.

As described above, the current value of the output current Iout-(1) is adjusted to be the reference value. Moreover, the current value of the drain current Id output from the output terminal 401 is adjusted to be the current value of the output current Iout-(K).

<Current Driving Apparatus>

Figure 15:
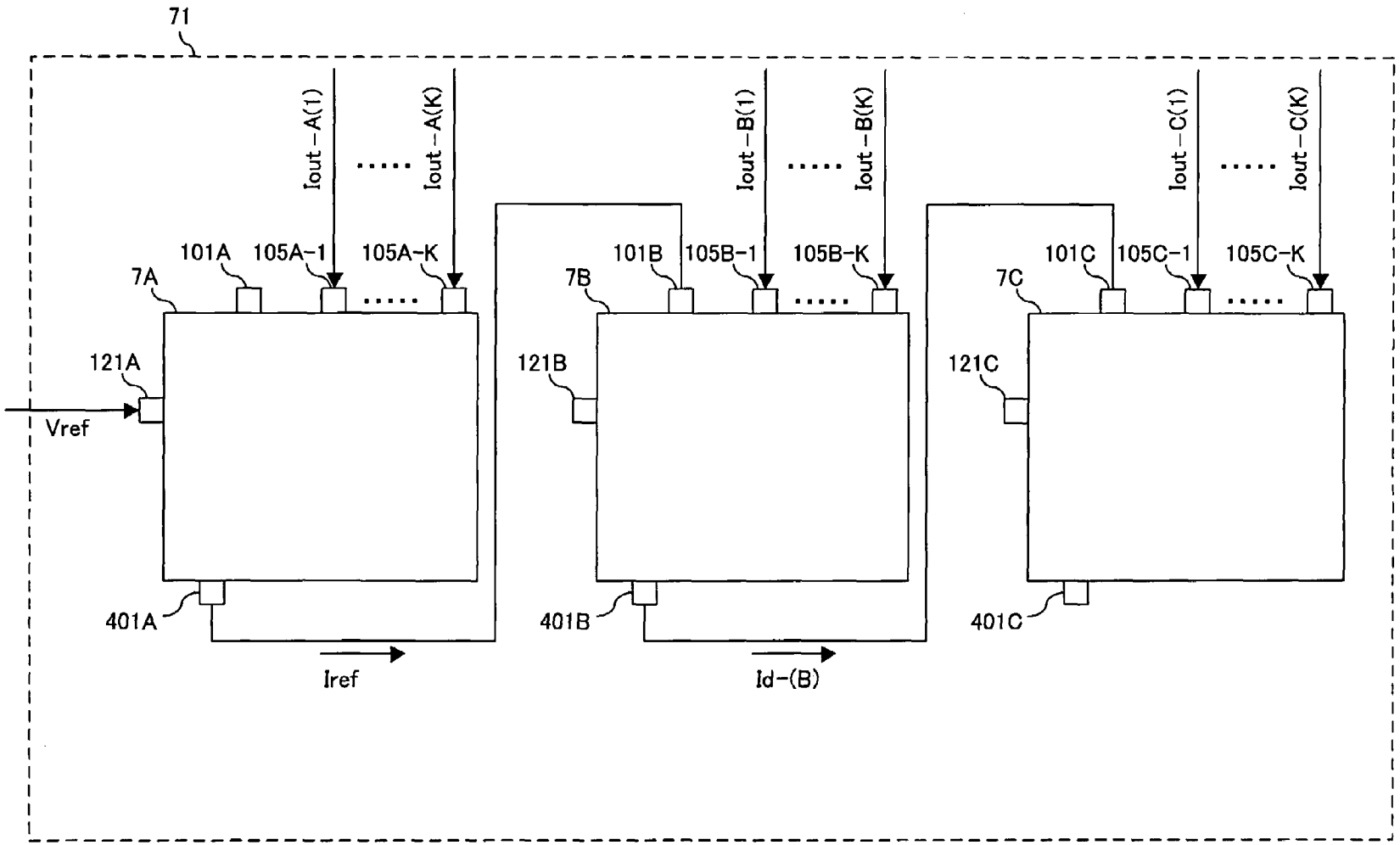
FIG. 15 is a diagram illustrating an overall configuration of a current driving apparatus according to the seventh embodiment of the present invention.

An overall configuration of a current driving apparatus 71 according to the seventh embodiment of the present invention is shown in FIG. 15. The current driving apparatus 71 includes current drivers 7A, 7B and 7C. Each of the current drivers 7A, 7B and 7C has the same configuration as that of the current driver 7 of FIG. 13. The current driver 7A is set to be a master. In the current driver 7A, the reference voltage Vref is supplied to an input terminal 121A from the outside. The current driver 7B is set to be a slave (2). In the current driver 7B, an input terminal 101B is connected to an output terminal 401A of the current driver 7A. The current driver 7C is set to be a slave (1). In the current driver 7C, an input terminal 101C is connected to an output terminal 401B of the current driver 7B.

<Operation>

Next, the operation of the driving apparatus 71 of FIG. 15 will be described.

[Current Driver 7A]

The current driver 7A is set to be a master. Therefore, the input terminal 121 receives the reference voltage Vref from the outside. The reference current Iref is not supplied to the input terminal 101A.

Next, in the current driver 7A, the same processing (i.e., driving processing, current value measurement processing and characteristic adjustment processing) as that of the current driver 7 (as a master) of FIG. 13 is performed. Accordingly, the bias voltage generation section 102 provided in the current driver 7A receives the reference current Iref corresponding to the voltage value of the reference voltage Vref supplied to the input terminal 121A from the supply transistor T123RB and outputs the bias voltage Vbias corresponding to the current value of the reference current Iref to the gate line G103. Moreover, output terminals 105A-1 through 105A-K output output currents Iout-A(1) through Iout-A(K) corresponding to the voltage value of the bias voltage Vbias generated by the bias voltage generation section 102 provided in the current driver 7A, respectively. Furthermore, the bias voltage generation section 102 provided in the current driver 7A receives the control signals CTa-1 through CTa-P and the control signals CTb-1 through CTb-P corresponding to the current value of the output current Iout-A(K).

Moreover, the output terminal 401A outputs the reference current Iref corresponding to the voltage value of the reference voltage Vref supplied to the input terminal 121A to the input terminal 101B of the current driver 7B.

[Current Driver 7B]

The current driver 7B is set to be a slave (2). Accordingly, an input terminal 121B does not receive the reference voltage Vref. The input terminal 101B receives the reference current Iref output from the output terminal 401 of the current driver 7A.

Next, in the current driver 7B, the same processing (i.e., driving processing, current value measurement processing and characteristic adjustment processing) as that of the current driving apparatus 7 (as a slave (2)) of FIG. 13 is performed. Accordingly, the bias voltage generation section 102 provided in the current driver 7B receives the reference current Iref output from the output terminal 401A of the current driver 7A and outputs the bias voltage Vbias corresponding to the current value of the reference current Iref to the gate line G103. Moreover, output terminals 105B-1 through 105B-K output output currents Iout-B(1) through Iout-B(K) corresponding to the voltage value of the bias voltage Vbias generated by the bias voltage generation section 102 provided in the current driver 7B, respectively. Furthermore, the bias voltage generation section 102 provided in the current driver 7B receives the control signals CTa-1 through CTa-P and the control signals CTb-1 through CTb-P.

Moreover, in the current driver 7B, the same processing (i.e., drain current adjustment processing) as that of the current driver 7 (as a slave (2)) of FIG. 13 is performed. Accordingly, the drain current generation section 701 provided in the current driver 7B receives the control signals CTd-1 through CTd-Q corresponding to a difference between the current value of the output current Iout-(1) and the current value of the output current Iout-(K). Moreover, the output terminal 401B outputs a drain current Id-(B) having an equal current value to a current value of the output current Iout-B(K).

[Current Driver 7C]

The current driver 7C is set to be a slave (1). Therefore, an input terminal 121C does not receive the reference voltage Vref. An input terminal 101C receives the drain current Id-(B) output from the output terminal 401B of the current driver 7B.

Next, in the current driver 7C, the same processing (i.e., driving processing, current value measurement processing and characteristic adjustment processing) as that of the current driver 7 (as a slave (1)) of FIG. 13 is performed. Accordingly, the bias voltage generation section 102 provided in the current driver 7C receives the drain current Id-(B) output from the output terminal 401B of the current driver 7B and outputs the bias voltage Vbias corresponding to the current value of the drain current Id-(B) to the gate line G103. Moreover, output terminals 105C-1 through 105C-K output output currents Iout-C(1) through Iout-C(K) corresponding to the voltage value of the bias voltage Vbias generated by the bias voltage generation section 102 provided in the current driving apparatus 7C, respectively. Furthermore, the bias voltage generation section 102 provided in the current driver 7C receives the control signals CTa-1 through CTa-P and the control signals CTb-1 through CTb-P corresponding to the current value of the output current Iout-C(1).

Figure 16A:
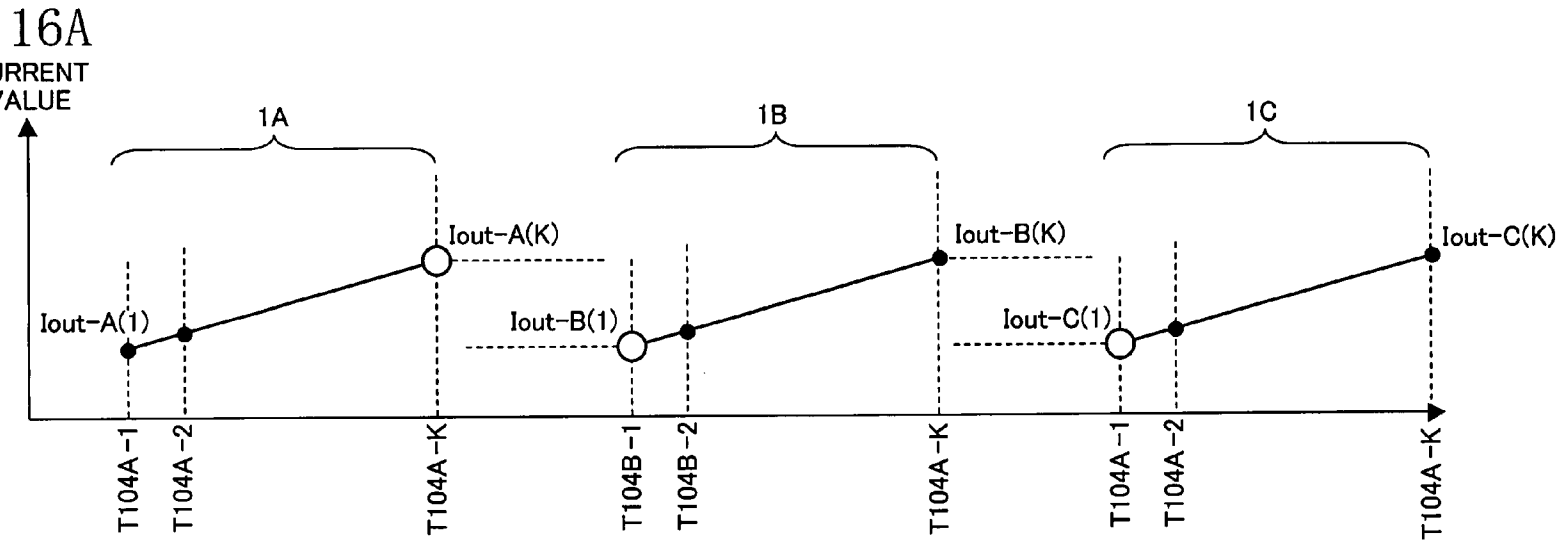
FIGS. 16A-16B are a graph showing the relationship between driving transistors and current values of output currents thereof.

Now, it is assumed that each of the driving transistors T104A-1 through T104A-K, the driving transistor T104B-1 through T104B-K and the driving transistors T104C-1 through T104C-K initially has the relationship shown in FIG. 16A with an associated one of the respective output currents of the output currents Iout-A(1) through Iout-A(K), the output currents Iout-B(1) through Iout-B(K) and the output currents Iout-C(1) through Iout-C(K) which flow in the driving transistors, respectively. In this case, there is a large difference between the current value of the output current Iout-A(K) flowing in the driving transistor T104A-K of the current driver 1A and the current value of the output current Iout-B(1) flowing in the driving transistor T104B-1 of the current driver 1B. There is also a large difference between the current value of the output current Iout-B(K) flowing in the driving transistor T104B-K of the current driver 1B and the current value of the output current Iout-C(1) flowing in the driving transistor T104C-1 of the current driver 1C.

Figure 16B:
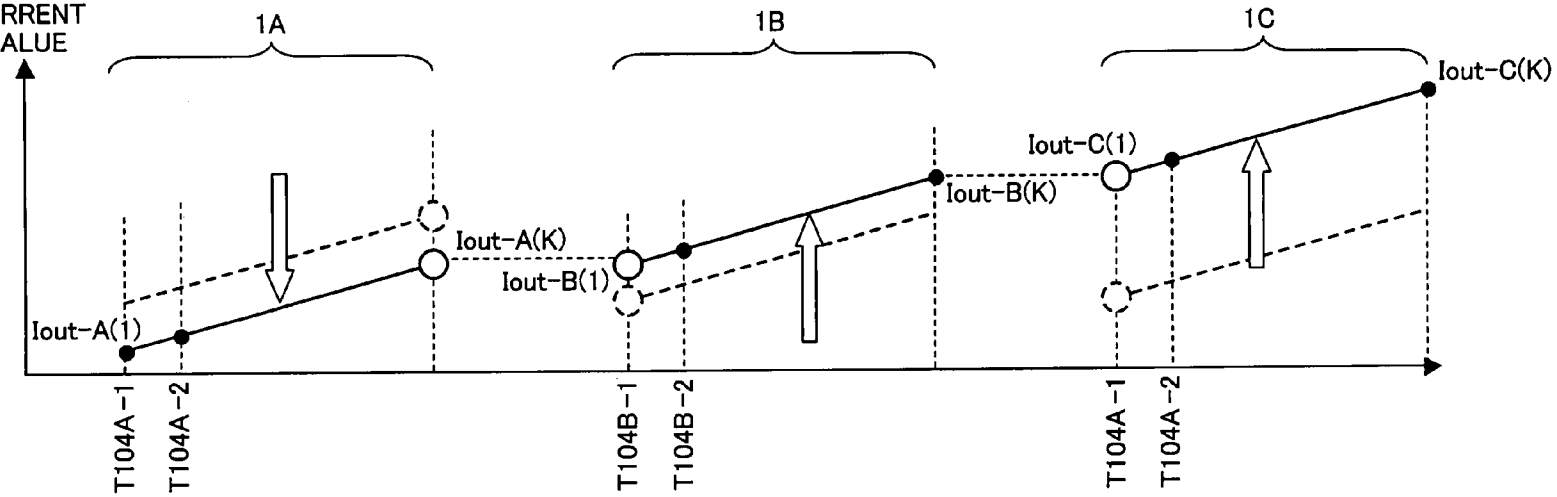

By the above-described operation, the current value of the output current Iout-A(K) flowing in the driving transistor T104A-K of the current driver 1A and the current value of the output current Iout-B(1) flowing in the driving transistor T104B-1 of the current driver 1B are adjusted to match each other. Moreover, the current value of the drain current Id-(B) output from an output terminal of the current driver 7B is equal to the current value of the output current Iout-B(K). Thus, the current value of the output current Iout-C(1) output from the output terminal 105C-1 of the current driver 7C becomes equal to the current value of the output current Iout-B(K). Accordingly, the relationship of each of the driving transistors T104A-1 through T104A-K, the driving transistors T104B-1 through T104B-K and the driving transistors T104C-1 through T104C-K with the associated one of the respective current values of the output currents Iout-A(1) through Iout-A(K), the output currents Iout-B(1) through Iout-B(K) and the output currents Iout-C(1) through Iout-C(K) are adjusted as shown in FIG. 16B.

<Effects>

As has been described above, a current driving apparatus using three or more current drivers can be formed.

Modified Example

Figure 17:
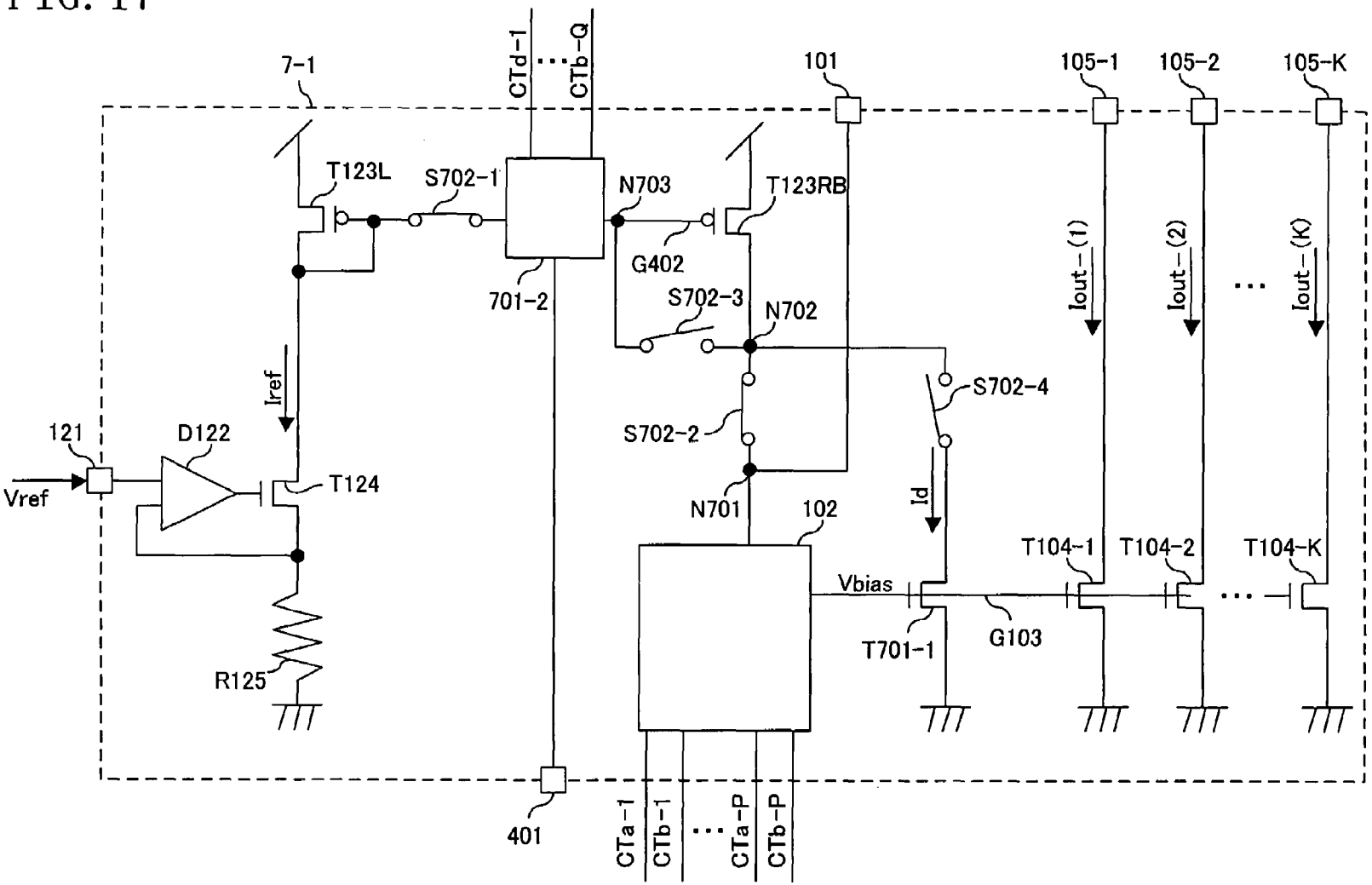
FIG. 17 is a diagram illustrating an overall configuration of a current driver according to a modified example of the seventh embodiment of the present invention.

An overall configuration of a current driver 7-1 according to a modified example of the seventh embodiment of the present invention is shown in FIG. 17. The current driver 7-1 includes the current generator transistor 701-1 of FIG. 17, instead of the drain current generation section 701 of FIG. 13, and a drain current adjusting section 701-2, instead of the supply transistor T123RA of FIG. 13. Other than that, the current driving apparatus 7-1 has the same configuration as the configuration of FIG. 13. The current generator transistor T701-1 generates the drain current Id having a current value corresponding to the voltage value of the bias voltage Vbias generated by the bias voltage generation section 102. The drain current adjusting section 701-2 adjusts the current value of the drain current generated by the current generator transistor T701-1, according to control signals CTe-1 through CTe-Q.

Figure 18:
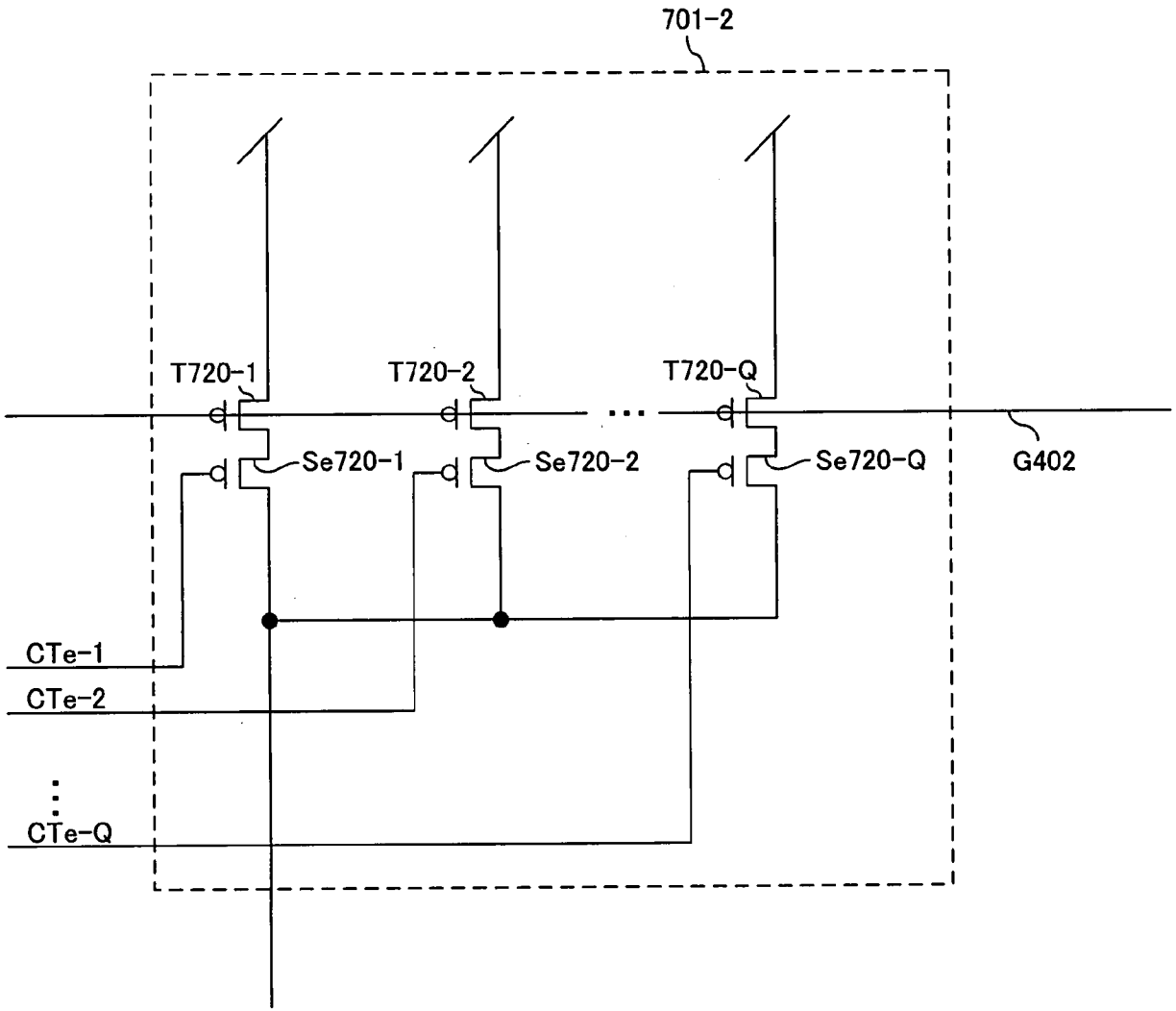
FIG. 18 is a diagram illustrating an internal configuration of a drain current adjustment section shown in FIG. 17.

An internal configuration of the drain current adjusting section 701-2 of FIG. 17 is shown in FIG. 18. The drain current adjusting section 701-2 includes Q adjusting transistors T720-1 through T720-Q and Q selection transistors Se720-1 through Se720-Q. The adjusting transistor T720-1 and the selection transistors Se720-1 are connected in series between a power supply node and an output terminal 401. The adjusting transistor T720-1 is connected between the power supply node and the selection transistor Se720-1 and has a gate connected to the gate line G402. The selection transistor Se720-1 is connected between the adjusting transistor T720-1 and the output terminal 401 and receives the control signal CTe-1 at a gate thereof. Each of the adjusting transistor T720-2 through T720-Q and an associated one of the selection transistors Se720-2 through Se720-Q are connected in series between a power supply node and the output terminal 401 in the same manner as the adjusting transistor T720-1 and the selection transistor Se720-1. Each of the selection transistors Se720-2 through Se720-Q is connected between the power supply node and the associated one of the selection transistors Se720-Q in the same manner as the adjusting transistor T720-1 and has a gate connected to the gate line G402. Each of the selection transistors Se720-2 through Se720-Q is connected between the associated one of the adjusting transistors T720-2 through T720-Q and the output terminal 401 and receives an associated one of the control signals CTe-2 through CTe-Q at a gate thereof in the same manner as the selection transistor Se720-1.

The control signals CTe-1 through CTe-Q are voltages which activate the selection transistors Se720-1 through Se720-Q (i.e., P-channel transistors), respectively, when being in the L level and negate the selection transistors Se720-1 through Se720-Q (i.e., P-channel transistors), respectively, when being in the H level.

With the above-described configuration, the current value of the drain current Id output from the output terminal 401 can be adjusted.

Eighth Embodiment

Figure 19:
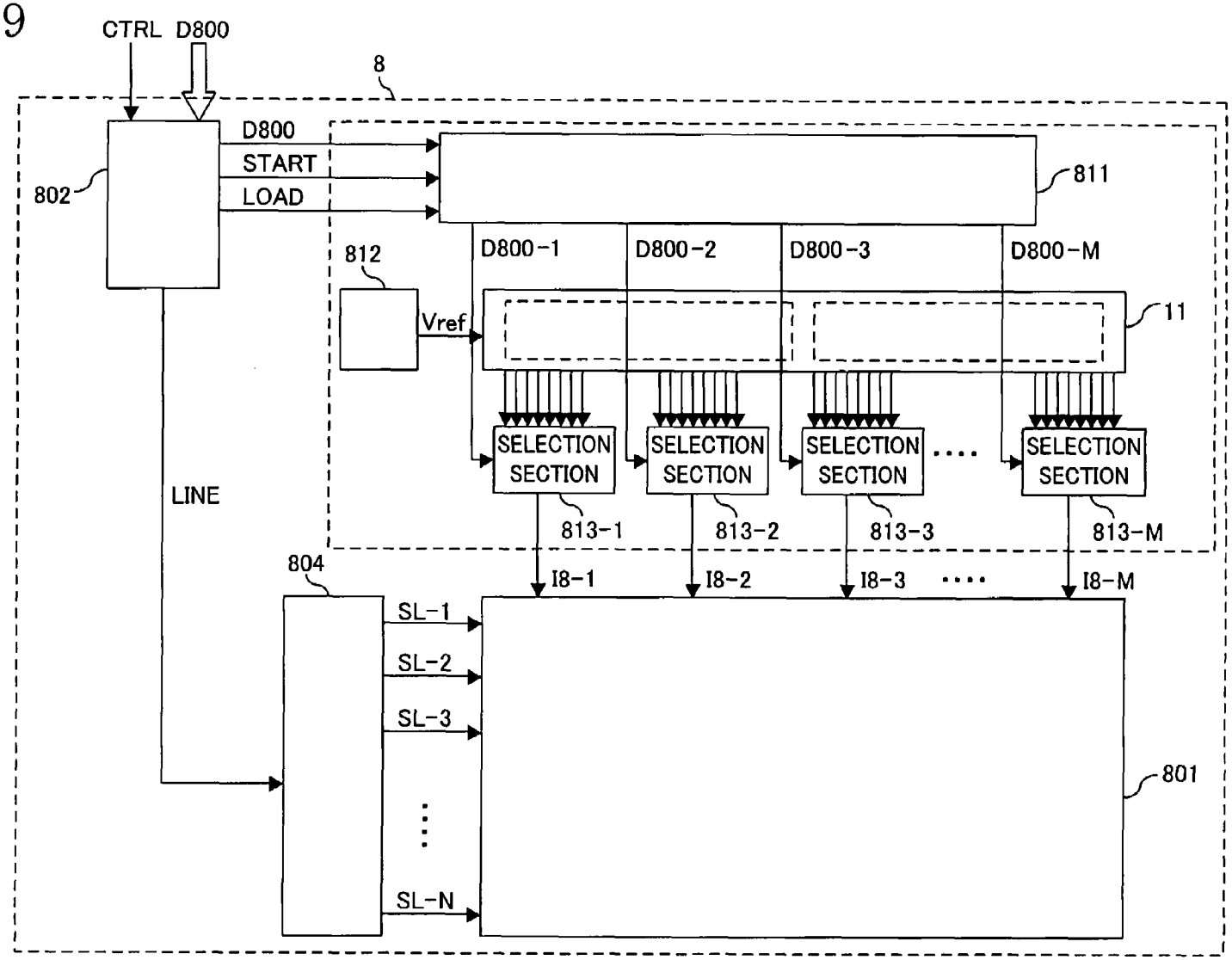
FIG. 19 is a diagram illustrating an overall configuration of a current driver according to an eighth embodiment of the present invention.
Figure 20:
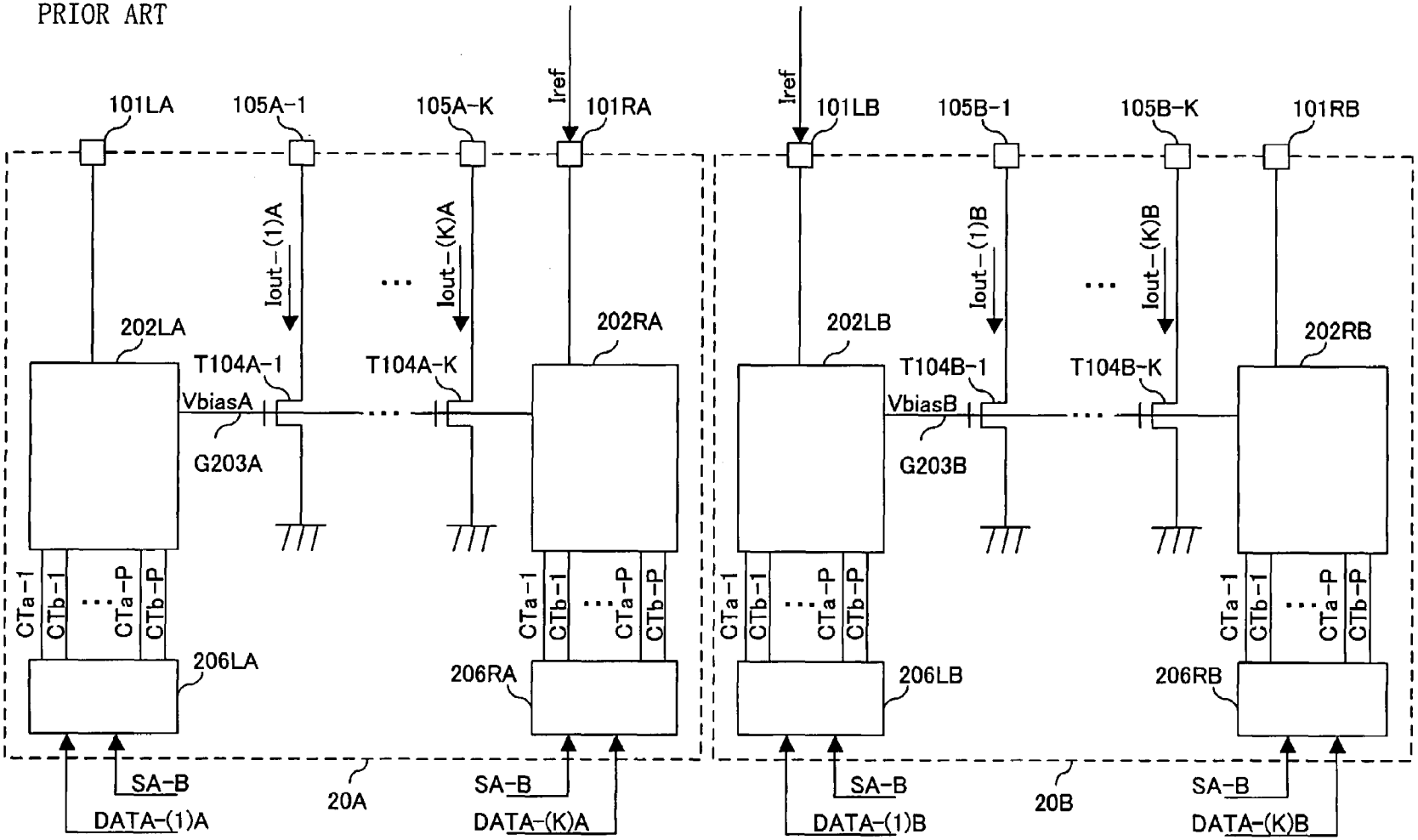
FIG. 20 PRIOR ART
FIG. 20 is a diagram illustrating an overall configuration of a known current driver.
Figure 21:
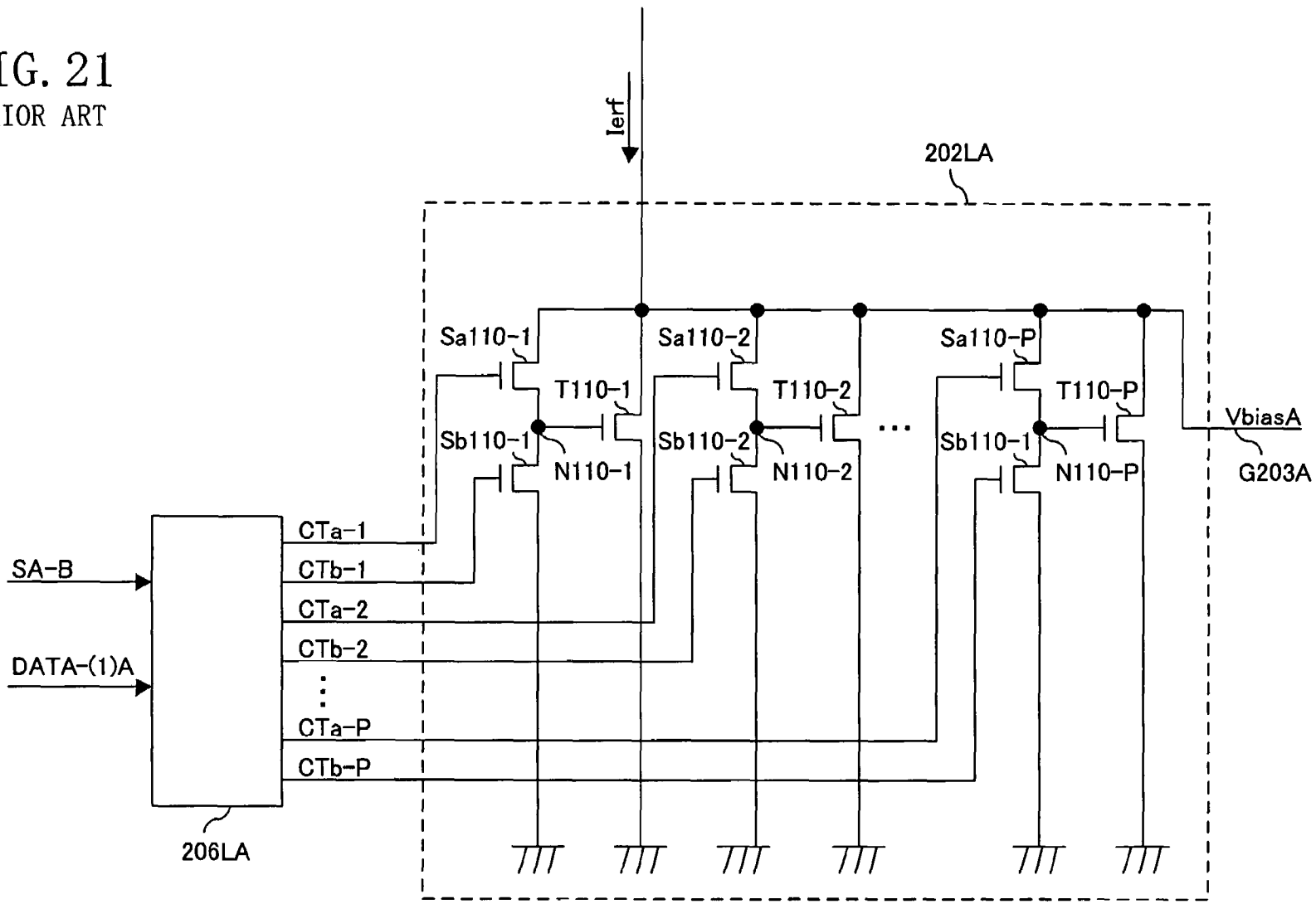
FIG. 21 PRIOR ART
FIG. 21 is a diagram illustrating an internal configuration of a bias voltage generation section shown in FIG. 20.

An overall configuration of a display device 8 according to an eighth embodiment of the present invention is shown in FIG. 19. The display device 8 includes a display panel 801, a control section 802, a data driver 803 and a gate driver 804. The display device 8 displays display data (3-bit data using an 8-level gray scale in this case) input from the outside on the display panel 801.

The display panel 801 includes M×N organic EL cells, M data lines and N gate lines (where M and N are natural numbers). In the display panel 801, the M×N organic EL cells are arranged in a matrix, the M data lines extend in the vertical direction and the N gate lines extends in the horizontal direction. Each of the organic EL cells is connected to an associated one of the data lines via a switching device and a gate of the switching device is connected to an associated one of the gate lines (i.e., a so-called an active matrix configuration). When one of the gate lines is activated, M switching devices (i.e., organic EL cells arranged in series in the horizontal direction) connected to the activated gate line connect ones of the organic EL cells associated with the switching devices and ones of the data lines associated with the switching devices, respectively.

When the control section 802 receives display data D800 and control information CTRK from the outside, the control section 802 outputs the display data D800, a start signal START and a load signal LOAD to the data driver 803 and also outputs a scanning control signal LINE to the gate driver 804. The display data D800 (which is data for one horizontal line of the display panel 801 in this case) includes a plurality of display data D800-1 through D800-M each of which indicates a gray scale level for a pixel. The control information CTRL contains various information such as a display timing. The start signal START is a signal indicating a timing of data holding for the display data D800 by the data driver 803. The load signal LOAD is a signal for indicating a timing of generation of driving currents I8-1 through I8-M by the data driver 803.

According to the display data D803 output from the control section 802, the data driver 803 outputs driving currents I8-1 through I8-M for driving the organic EL cells of the display panel 801 to the M data lines provided in the display panel 801.

According to the scanning control signal LINE from the control section 802, the gate driver 804 outputs scanning signals SL-1 through SL-N to the N gate lines provided in the display panel 801 (where N is a natural number). In this case, the gate driver 804 outputs the scanning signals SL-1 through SL-N to the N gate lines in descending order from the upper most one of the gate lines (i.e., a so-called line-sequential driving method).

<Internal Configuration of Data Driver 803>

The data driver 803 of FIG. 19 includes a data latch section 811, a reference voltage source 812, the current driving apparatus 11 of FIG. 2 and M selection sections 813-1 through 813-M.

According to the start signal START output from the control section 802, the data latch section 811 maintains the display data D800 output from the control section 802 as a plurality of display data D800-1 through D800-M each of which corresponds to a pixel. Moreover, the data latch section 811 outputs the maintained display data D800-1 through D800-M each corresponding to a pixel to the selection sections 813-1 through 813-M, respectively, according to the load signal LOAD output from the control section 802.

The reference voltage source 812 supplies the reference voltage Vref to the current driving apparatus 11.

The driving apparatus 11 outputs a plurality of output currents Iout to the selection sections 813-1 through 813-M using the reference voltage Vref supplied by the reference voltage source 812 (e.g., in this case, each of the current drivers 1A and 1B provided in the current driving apparatus 11 includes ((8×M)/2)) driving transistors and outputs eight output currents Iout to each of the selection sections 813-1 through 813-M).

Each of the selection sections 813-1 through 813-M selects, from the eight output currents Iout output from the large-current driving apparatus 11, output currents of a number corresponding to a gray scale level indicated by an associated one of the display data D800-1 through D800-M which are output from the data latch section 811 and each of which corresponds to a pixel. Moreover, the selection sections 813-1 through 813-M are in a one-to-one correspondence with the M data lines provided in the display panel 801 and output, as driving currents I8-1 through I8-M, a current obtained by summing all of the selected ones of the output currents Iout to the data lines, respectively.

<Operation>

Next, in the operation of the display apparatus 8 of FIG. 19, a flow from the process step of outputting the output current Iout by the current driving apparatus 11 to the process step of driving the organic EL cells of the display panel 801 will be described.

First, the current driving apparatus 11 outputs eight output currents Iout to each of the selection sections 813-1 through 813-M.

According to the display data D800-1 through D800-M output from the data latch section 811, each of the selection sections 813-1 through 813-M selects, from the eight output currents Iout output from the current driving apparatus 11, output currents Iout of a number corresponding to a gray scale level indicated by an associated one of the display data D800-1 through D800-M. For example, if the display data D800-1 indicates "gray scale=7", the selection section 813-1 selects seven output currents Iout from the eight output currents Iout. The same operation is performed in each of the selection sections 813-2 through 813-M, and each of the M data lines receives an associated one of the driving currents I8-1 through I8-M from an associated one of the selection sections 813-1 through 813-M.

According to the scanning control signal LINE output from the control section 802, the gate driver 804 outputs scanning signals SL-1 through SL-N. In this case, if the gate driver 804 outputs the scanning signal SL-1 to one of the gate line in the display panel 801 provided in the uppermost stage, M switching devices connected to the uppermost gate line are activated. Thus, M organic EL cells provided in the upper most stage in the display panel 801 are connected to corresponding data lines, respectively, and receive the driving currents I8-1 through 100-M flowing through the corresponding data lines, respectively.

Next, the M organic EL cells provided in the uppermost stage of the display panel 801 emit lights corresponding to current values of the driving currents I8-1 through I8-M, respectively. Each of the driving currents I8-1 through I8-M has a current value corresponding to a gray scale level represented by an associated one of the display data D800-1 through D800-M. Accordingly, a brightness of each of the M organic EL cells becomes the gray scale level represented by an associated one of the display data D800-1 through D800-M. Therefore, the display data D800 for a horizontal line is displayed in a horizontal line provided in the uppermost stage.

The same processing is performed to all horizontal lines, thereby displaying 3-bit (=8-gray scale level) on the display panel 801.

<Effects>

Respective output values of output currents from the current driving apparatus 11 are uniform (or exhibit a certain tilt). Therefore, the selection sections 813-1 through 813-M can generate the driving currents I8-1 through I8-M corresponding to the gray scale levels indicated by the display data D800-1 through D800-M, respectively, with high accuracy. Accordingly, variation in light emission in the display panel 801 can be reduced.

Moreover, in this embodiment, the current driving apparatus 11 of the first embodiment is provided. However, even with the configuration in which a current driving apparatus using a current driver of one of the second through seventh embodiments is provided, the same effects can be achieved.

Moreover, in this embodiment, the configuration in which M pixels are provided in a single horizontal line of the display panel 801 and an organic EL cell is provided for each pixel is used. However, a configuration in which three organic EL cells (i.e., an organic cell corresponding to a R component, an organic EL cell corresponding to a G component and an organic EL cell corresponding to a B component) are provided for each pixel may be used. In this case, the display data D800 includes (M×3) display data D800-1 through D800-(M×3). Moreover, the data driver 803 includes three driving apparatuses and (M×3) selection sections 813-1 through 813-(M×3). Each of the three current driving apparatuses outputs an output current Iout having a current value suitable to the R component, the G component or the B component. Among the selection sections 813-1 through 813-(M×3), a selection section 813-(3X−2) (where X is a natural number: 1≦X≦M) receives the output current Iout from one of the current driving apparatuses corresponding to the R component, a selection section 813-(3X−1) receives an output current Iout from one of the current driving apparatuses corresponding to the G component and a selection section 813-(3*x*) receives an output current Iout from one of the current driving apparatuses corresponding to the B component. Moreover, the data latch section 811 outputs the display data D800-(3X−2) corresponding to the R component to the selection section 813-(3X−2), the display data D800-(3X−1) corresponding to the G component to the selection section 813-(3X−1) and the display data D800-(3X) corresponding to the B component to the selection section D800-(3X). Thus, the organic EL cells corresponding to the R component, the G component and the B component have a brightness in accordance with the display data D800-(3X−2) corresponding to the R component, a brightness in accordance with the display data D800-(3X−1) corresponding to the G component and a brightness in accordance with the display data D800-(3X) corresponding to the B component, respectively. As described above, in the current driving apparatuses, the respective brightnesses of the organic EL cells provided for the R, G and B components, respectively, can be separately adjusted by adjusted the current values of the output currents Iout. Therefore, a brightness of each pixel can be controlled with high accuracy.

A current driver according to the present invention is useful for a current-driven display driver or the like used in, for example, an organic EL panel. Also, an inventive driver is applicable to, for example, a printer driver which includes a plurality of separate circuit blocks and outputs currents of the separate circuit blocks with adjusted currents values with high accuracy.

What is claimed is:

1. A current driver which has a first mode and a second mode, the current driver comprising:

a current supply section;

a first input terminal;

a bias voltage generation section for generating a bias voltage;

a first gate line receiving the bias voltage generated by the bias voltage generation section; and, K driving transistors each being connected between an output node from which an output current is output and a first reference node indicating a first voltage value, where K is a natural number, respective gates of the K driving transistors are connected to the first gate line;

wherein in the first mode, the current supply section supplies a first current, and the bias voltage generation section generates the bias voltage according to the first current supplied from the current supply section, wherein in the second mode, the first input terminal receives a current from the outside of the current driver, and the bias voltage generation section generates the bias voltage according to the current supplied to the first input terminal, and wherein in the bias voltage generation section, the relationship, which is also referred to as current-voltage conversion capability, between a current value of a current received by the bias voltage generation section and the voltage value of the bias voltage generated by the bias voltage generation section is adjusted, according to a current value of the output current flowing in a first driving transistor of the K driving transistors, in the first mode, and the current-voltage conversion capability is adjusted, according to a current value of an output current flowing in a second driving transistor of the K driving transistors, in the second mode.

2. The current driver of claim 1, wherein the bias voltage generation section includes P voltage generation transistors connected in parallel between the first input terminal and the first reference node, where P is a natural number, wherein each of the P voltage generation transistors has a gate and a drain connected to each other, wherein the first gate line receives a gate voltage generated in each of the P voltage generation transistors, and wherein the number P of the voltage generation transistors is adjusted, according to a current value of an output current flowing in the first driving transistor, in the first mode and the number P of the voltage generation transistors is adjusted, according to a current value of an output current flowing in the second driving transistor, in the second mode.

3. The current driver of claim 2, further comprising a connection section for connecting a gate and a drain of each of X voltage generation transistors out of the P voltage generation transistors, where X is a natural number and $X \leqq P$, wherein the number X of current generator transistors in which a gate and a drain are connected to each other by the connection section is adjusted, according to the current value of the output current flowing in the first driving transistor, in the first mode and the number X of the current generator transistors in which a gate and a drain are connected to each other by the connection section is adjusted, according to the current value of the output current flowing in the second driving transistor, in the second mode, and wherein the first gate line receives a gate voltage generated in each of respective gates of the X voltage generation transistors in which a gate and a drain are connected to each other by the connection section.

4. The current driver of claim 3, further comprising a control section for selecting X voltage generation transistors from the P voltage generation transistors, where X is a natural number and $X \leqq P$, wherein the control section selects X voltage generation transistors from the P voltage generation transistors, according to the current value of the output current flowing in the first driving transistor, in the first mode and, the control section selects X voltage generation transistors from the P voltage generation transistors, according to the current value of the output current flowing in the second driving transistor, in the second mode, and wherein in each of the X voltage generation transistors selected by the control section, the connection section connects a gate and a drain thereof.

5. The current driver of claim 4, further comprising a storage section for storing information indicating voltage generation transistors to be selected from the P voltage generation transistors by the control section, wherein the control section selects, from the P voltage generation transistors, the X voltage generation transistors indicated by the information stored in the storage section.

6. The current driver of claim 5, wherein the storage section includes a plurality of fuses, wherein the control section has a condition fixing mode and an emulation mode, and wherein the control section selects, in the condition fixing mode, X voltage generation transistors from the P voltage generation transistors, according to states of the fuses with respect to whether the fuses are blown or not, and the control section emulates, in the emulation mode, the states of the fuses with respect to whether or not the fuses are blown or not, thereby selecting X voltage generation transistors from the P voltage generation transistors.

7. The current driver of claim 1, wherein the current supply section includes a second input terminal, a voltage-current conversion section, an output terminal, a setting transistor connected between a second reference node indicating a second voltage value and the voltage-current conversion section, and having a gate and a drain connected to each other, a first supply transistor connected between the second reference node and the output terminal, a second supply transistor connected between the second reference node and the bias voltage generation section, and a second gate line to which a gate of the setting transistor, a gate of the first supply transistor and a gate of the second supply transistor are connected, wherein in the first mode, the second input terminal receives a reference voltage having a predetermined voltage value, the voltage-current conversion section generates the first current according to the reference voltage supplied to the second input terminal, the output terminal outputs the first current flowing in the first supply transistor, and the bias voltage generation section generates the bias voltage according to the first current flowing in the second supply transistor.

8. The current driver of claim 7, further comprising a switching device connected between the second gate line and the second reference node, wherein the switching device is turned OFF in the first mode and is turned ON in the second mode.

9. The current driver of claim 7, further comprising a switching device connected between the second supply transistor and the bias voltage generation section, wherein the switching device is turned ON in the first mode and is turned OFF in the second mode.

10. The current driver of claim 7, wherein the second gate line includes a third node, a fourth node, a fifth node, and a sixth node, the fifth node being provided between the third node and the fourth node, the sixth node being provided between the fourth node and the fifth node, the gate of the setting transistor is connected to the third node, the gate of the first supply transistor is connected to the fifth node, the gate of the second supply transistor is connected to the fourth node, wherein the current driver further includes a drain current generation section for generating a second current having a current value corresponding to a voltage value of the bias voltage generated by the bias voltage generation section, a first switching device connected to the second gate line between the third node and the fifth node, a second switching device connected between a seventh node and the bias voltage generation section, the seventh node being provided between the second supply transistor and the bias voltage generation section, a third switching device connected between the sixth node and the seventh node, and a fourth switching device connected between the seventh node and the drain current generation section, wherein in the first mode, the first and second switching devices are turned ON and the third and fourth switching devices are turned OFF, wherein in the second mode, the first and second switching devices are turned OFF and the third and fourth switching devices are turned OFF, and in the drain current generation section, the relationship between a voltage value of a bias voltage received by the drain current generation section itself and a current value of the second current generated by the drain current generation section itself is adjusted, according to the respective current values of the output currents flowing in the first and second driving transistors.

11. The current driver of claim 10, wherein the drain current generation section includes Q current generator transistors connected in parallel between the fourth switching device and the first reference node, where Q is a natural number, wherein each of the Q current generator transistors receives, at a gate thereof, the bias voltage generated by the bias voltage generation section, and the number Q of the current generation transistors is adjusted according to the respective current values of the output currents flowing in the first and second driving transistors.

12. A data driver comprising:

the current driver of claim 1 being set to be the first mode;

the current driver of claim 1 being set to be the second mode;

a selection section for selecting N output currents from K output currents output by the current driver which is set to be in the first mode and K output currents output by the current driver which is set to be in the second mode, according to display data input from the outside, where N is a natural number and $N \leqq 2K$; and a driving current output terminal from which a current obtained by summing the N output currents selected by the selection section is output as a driving current, wherein the display data indicates a gray scale level.

13. A display device comprising:

the data driver of claim 12; and a display panel driven by a driving current output from the data driver.

14. A method for driving a current driver which includes a current supply section, a first input terminal, a bias voltage generation section for generating a bias voltage, a first gate line receiving the bias voltage generated by the bias voltage generation section, K driving transistors each being connected between an output node from which an output current is output and a first reference node indicating a first voltage value, where K is a natural number, respective gates of the K driving transistors are connected to the first gate line, the method comprising the steps of:

a) supplying via the current supply section a first current, and generating via the bias voltage generation section the bias voltage according to the first current supplied from the current supply section, b) receiving through the first input terminal a current from the outside of the current driver, and generating via the bias voltage generation section the bias voltage according to the current supplied to the first input terminal, c) measuring a current value of an output current flowing in a first driving transistor of the K driving transistors in the step a), and measuring a current value of an output flowing in a second driving transistor of the K driving transistors, which is different from the first transistor in the step b); and d) adjusting the relationship, which is also referred to as current-voltage conversion capability, between a current value of a current received by the bias voltage generation section and a voltage value of the bias voltage generated by the bias voltage generation section, according to a measured current value of an output current in the step c).

15. The method of claim 14, wherein when the bias voltage generation section includes P voltage generation transistors connected in parallel between the first input terminal and the first reference node, where P is a natural number, each of the P voltage generation transistors has a gate and a drain connected to each other, and the first gate line receives a gate voltage generated in each of the P voltage generation transistors, in the step d), the number P of the voltage generation transistors is adjusted, according to the current value of the output current flowing in the first driving transistor, in the step a), and the number P of the voltage generation transistors is adjusted, according to the current value of the output current flowing in the second driving transistor, in the step b).

16. The method of claim 15, further comprising a step e) of connecting a gate and drain of each of X voltage generation transistors selected from the P voltage generation transistors, where X is a natural number and $X \leqq P$, wherein in the step e), the number X of the voltage generation transistors in which a gate and a drain are connected to each other is adjusted, according to the current value of the output current flowing in the first driving transistor, in the step a), the number X is adjusted, according to the current value of the output current flowing in the second driving transistor, in the step b), and the gate line receives the gate voltage generated in each of the respective gates of the X voltage generation transistors in which a gate and a drain are connected to each other in the step e).

17. The method of claim 16, further comprising the step f) of selecting the X voltage generation transistors from the P voltage generation transistors, according to the current value of the output current flowing in the first driving transistor, in the step a), and selecting the X voltage generation transistors from the P voltage generation transistors, according to the current value of the output current flowing in the second driving transistor, in the step b), where X is a natural number and $X \leqq P$ wherein in the step e), each of the X voltage generation transistors selected in the step f), a gate and drain of each of the X voltage generation transistors are connected to each other.

18. The method of claim 17, further comprising the step g) of storing, in a storage medium, information indicating voltage generation transistors to be selected from the P voltage generation transistors in the step f), wherein in the step f), the X voltage generation transistors are selected from the P voltage generation transistors, according to the information stored in the storage medium in the step g).

* * * * *